US009975342B2

(12) United States Patent
Tamaki

(10) Patent No.: US 9,975,342 B2
(45) Date of Patent: May 22, 2018

(54) LIQUID EJECTION APPARATUS

(71) Applicant: BROTHER KOGYO KABUSHIKI KAISHA, Nagoya-shi, Aichi-ken (JP)

(72) Inventor: Shuichi Tamaki, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 48 days.

(21) Appl. No.: 14/947,862

(22) Filed: Nov. 20, 2015

(65) Prior Publication Data

US 2016/0288506 A1 Oct. 6, 2016

(30) Foreign Application Priority Data

Mar. 31, 2015 (JP) ..... 2015-074426

(51) Int. Cl.
*B41J 2/165* (2006.01)

(52) U.S. Cl.
CPC ..... *B41J 2/16508* (2013.01); *B41J 2/1652* (2013.01); *B41J 2/16523* (2013.01); *B41J 2/16526* (2013.01); *B41J 2002/16573* (2013.01)

(58) Field of Classification Search
CPC .. B41J 2/16508; B41J 2/1652; B41J 2/16526; B41J 2/16523; B41J 2002/16573; B41J 2002/16594; B41J 2002/16597
See application file for complete search history.

(56) References Cited

U.S. PATENT DOCUMENTS

| | | | | |
|---|---|---|---|---|
| 5,170,186 | A | 12/1992 | Shimamura et al. | |
| 2005/0012776 | A1 | 1/2005 | Kato et al. | |
| 2006/0214981 | A1* | 9/2006 | Fukasawa | B41J 2/16523 347/29 |
| 2011/0242207 | A1 | 10/2011 | Nakazawa | |

FOREIGN PATENT DOCUMENTS

| | | | |
|---|---|---|---|
| JP | 2675887 | B2 | 11/1997 |
| JP | 2005-035255 | A | 2/2005 |
| JP | 2008-221796 | A | 9/2008 |
| JP | 2011-207025 | A | 10/2011 |

* cited by examiner

*Primary Examiner* — Julian Huffman
*Assistant Examiner* — Michael Konczal
(74) *Attorney, Agent, or Firm* — Merchant & Gould P.C.

(57) ABSTRACT

A controller executes a regular maintenance process each time when a time elapsed from completion of a previous regular maintenance process reaches a first time. the regular maintenance process included a purge operation for discharging liquid from an ejection port to the inner space of a cap member and a first discharge operation for discharging liquid in a recess portion of the cap member to a waste liquid tank without discharging liquid after the purge operation. The controller executes a second liquid discharge operation for discharging liquid in a first connection channel to the waste liquid tank without discharging liquid from the ejection port when the time elapsed from the completion of the previous regular maintenance process reaches a second time being shorter than the first time.

18 Claims, 18 Drawing Sheets

LIQUID EJECTION APPARATUS

CROSS-REFERENCE TO RELATED APPLICATION

This application claims priority from Japanese Patent Application No. 2015-074426, filed on Mar. 31, 2015, which is incorporated herein by reference.

BACKGROUND OF THE INVENTION

1. Field of the Invention

The present invention relates to a liquid ejection apparatus.

2. Description of the Related Art

Japanese Unexamined Patent Application Publication No. 2011-207025 discloses an ink-jet printer including a maintenance mechanism that allows switching among a suction purge for recovery from an ejection failure by sucking ink from the nozzles of an ink jet head, an exhaust operation for recovery from an ejection failure caused by the growth of bubbles by sucking ink together with the bubbles from an exhaust channel in a subtank for supplying ink to the ink jet head, and an ink discharge operation for discharging ink remaining in a tube connecting a suction pump for use in the suction purge and the exhaust operation and a waste liquid tank. This ink jet printer executes the liquid discharge operation just before a suction purge (a liquid sucking operation) in a periodic suction purge (a sucking process). This allows the suction purge to be executed after thickened ink remaining in the tube is discharged. This prevents the tube from coming out of the pump due to an increase in the pressure in the tube when the suction purge is executed.

The ink-jet printer disclosed in Japanese Unexamined Patent Application Publication No. 2011-207025 executes the liquid discharge operation just before the suction purge of the periodic suction purge. The periodic suction purge is executed every one or two months, for example. The liquid discharge operation is executed also after the periodic suction purge, but a little ink sometimes remains in a cap after completion of the liquid discharge operation because the cap is increased in size as a result of a move to large-sized liquid ejection heads for high-speed printing. The ink remaining in the cap collects to the tube connecting the suction pump and the waste liquid tank and a tube connecting the suction pump and the cap (connecting channels). The ink (liquid) collecting in the tubes increases in viscosity, so that the ink in the tubes cannot be sucked in a suction purge. If the suction purge etc. are not performed, during which the ink does not flow in the tubes for a long time, so that the viscosity of the ink increases, the ink cannot be discharged even if the liquid discharge operation is executed, and the clogging of the tubes cannot be resolved. Thus, no actual suction purge or exhaust operation can be executed even if a suction purge or an exhaust operation is executed.

SUMMARY OF THE INVENTION

Accordingly, it is an object of the present invention to provide a liquid ejection apparatus in which a failure in discharging liquid in a connecting channel using a pump due to an increase in the viscosity of the liquid can be prevented.

A liquid ejection apparatus according to an aspect of the present invention includes a liquid ejection head comprising an ejection port and a cap member comprising a recess portion, the cap member configured to be in selective contact with the liquid ejection head to cover the ejection port, the recess portion forming an inner space of the cap member with the liquid ejection head when the cap member is in contact with the liquid ejection head. The liquid ejection apparatus includes a selector configured to select one of a first state in which the inner space formed by the recess portion and the liquid ejection head is not communicated with an outer space of the cap member when the cap member is in contact with the liquid ejection head and a second state in which the recess portion is communicated with the outer space of the cap member, a waste liquid tank, and a pump. The liquid ejection apparatus includes a first connection channel fluidly connecting the recess portion of the cap member and the pump, a second connection channel fluidly connecting the pump and the waste liquid tank and a timer. The liquid ejection apparatus includes a controller configured to: if a first time period measured by the timer has elapsed from completion of a previous regular maintenance, then control the selector and the pump to perform a regular maintenance process that includes a purge operation in which liquid is discharged from the ejection port to the inner space of the cap member in the first state, and a first discharge operation in which liquid in the recess portion of the cap member is discharged to the waste liquid tank without discharging liquid from the ejection port in the second state after the purge operation; and if the first time period measured by the timer has not elapsed from completion of a previous regular maintenance, and if a second time period measured by the timer has elapsed from completion of the previous regular maintenance, the second time period being shorter than the first time period, then control the selector and the pump to perform a second liquid discharge operation in which liquid in the first connection channel is discharged to the waste liquid tank without discharging liquid from the ejection port in the second state. In a further aspect, the liquid ejection apparatus includes a liquid ejection head comprising an ejection port, a cap member comprising a recess portion, the cap member configured to be in selective contact with the liquid ejection head to cover the ejection port, the recess portion forming an inner space of the cap member with the liquid ejection head when the cap member is in contact with the liquid ejection head, and a selector configured to select one of a first state which the inner space formed by the recess portion and the liquid ejection head is not communicated with an outer space of the cap member when the cap member is in contact with the liquid ejection head and a second state which the recess portion is communicated with the outer space of the cap member. The liquid ejection apparatus includes a waste liquid tank, a pump, and a first connection channel fluidly connecting the recess portion of the cap member and the pump. The liquid ejection apparatus includes a second connection channel fluidly connecting the pump and the waste liquid tank and a timer. The liquid ejection apparatus includes a controller configured to: continuously monitor the timer, if a predetermined time period measured by the timer has elapsed from completion of the previous regular maintenance, then control the selector and the pump to perform a liquid discharge operation in which liquid in the first connection channel is discharged to the waste liquid tank without discharging liquid from the ejection port in the second state, wherein the predetermined time period is: shorter than a predetermined maintenance time elapsed from completion of a previous regular maintenance, equal to or longer than an arrival period when liquid remaining in the recess portion of the cap member arrives at the first connection channel, and shorter than a solidification time when the liquid in the first connection channel solidifies, wherein the solidification time is shorter than the predetermined maintenance time.

With the liquid ejection apparatus according to an aspect of the present invention, a second liquid discharge process in which at least one second liquid discharge operation is performed between adjacent two regular maintenance processes is executed. The purge operation in the regular maintenance process is performed during an unflowable time in which the liquid in the first connection channel cannot be discharged with the pump due to an increase in the viscosity of the liquid. This can prevent a failure in discharging the liquid in the first connection channel with the pump due to an increase in the viscosity of the liquid accumulated with time. This improves the reliability of execution of the purge operation in the regular maintenance process.

DESCRIPTION OF THE PREFERRED EMBODIMENTS

A multifunction device 1 incorporating a printer unit according to an embodiment of the present invention will be described hereinbelow. The multifunction device 1 is installed in the state shown in FIG. 1. In this embodiment, three directions, a vertical direction, a front-to-back direction, and a lateral direction are respectively indicated by arrows A1, A2, and A3 in FIG. 1. The three directions shown in FIG. 1 also apply to the other drawings.

Outline of Multifunction Device 1

Figure 1:
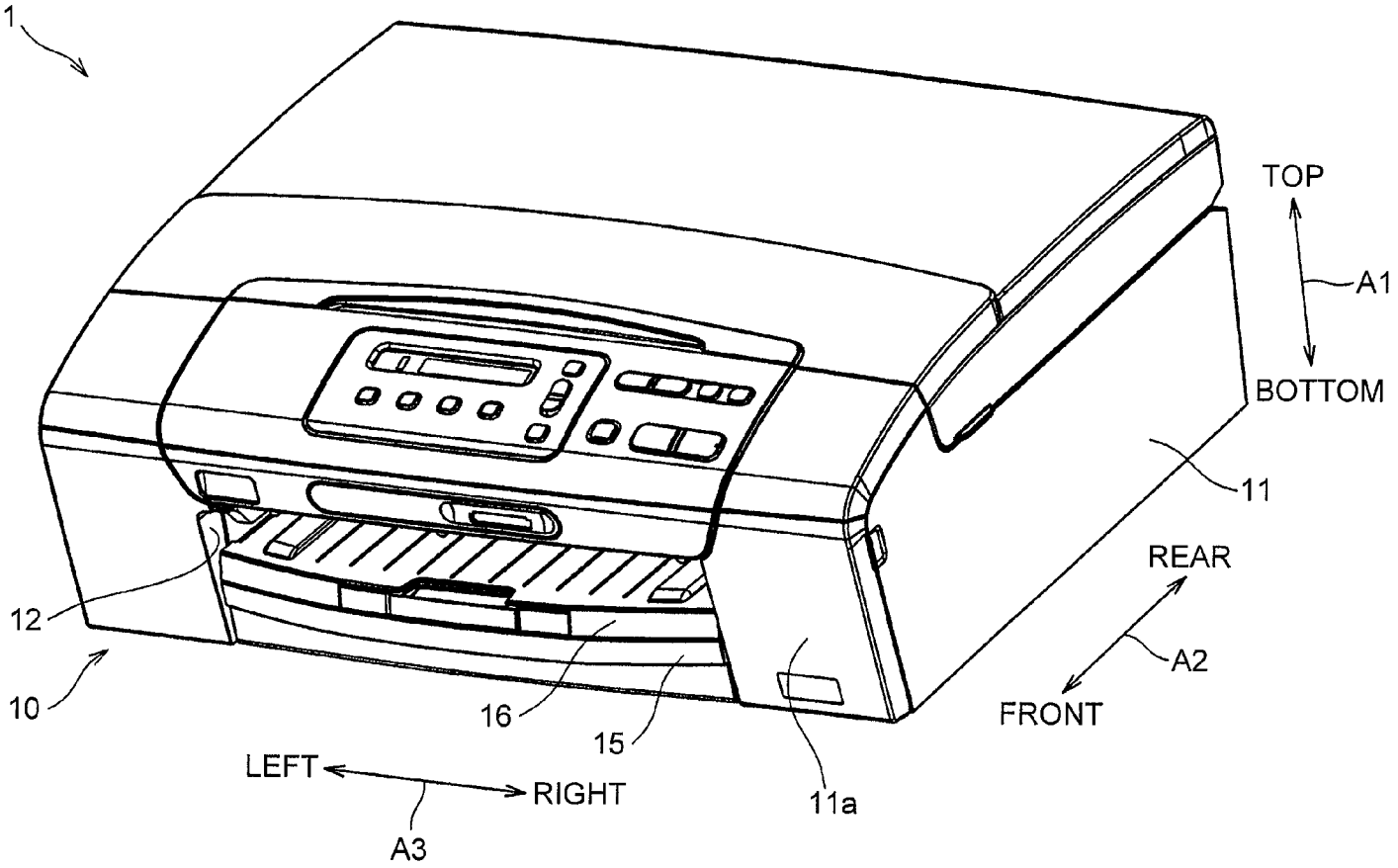
FIG. 1 is a perspective view of a multifunction device.

As shown in FIG. 1, the multifunction device 1 is a substantially low-profile rectangular parallelepiped, which includes a display and operation buttons on the top. A printer unit 10, which is an example of a liquid ejection apparatus according to an embodiment of the present invention, is provided at the lower part of the multifunction device 1. The multifunction device 1 has various functions, such as a scanner function and a printer function.

The printer unit 10 includes a casing 11. The casing 11 has an opening 12 substantially at the center of a front wall 11*a*. A paper feed tray 15 and an output tray 16 are provided at two upper and lower stages. The paper feed tray 15 can be detached through the opening 12 in the front-to-back direction A2, that is, can be detached from the casing 11. A desired size of paper P is placed on the paper feed tray 15. The multifunction device 1 can be connected to an external device, such as a personal computer (hereinafter referred to as PC) and executes a recording operation in accordance with a recording instruction from the PC. The multifunction device 1 executes various functions in accordance with user's operation on the operation buttons.

Inner Structure of Printer Unit 10

Figure 2:
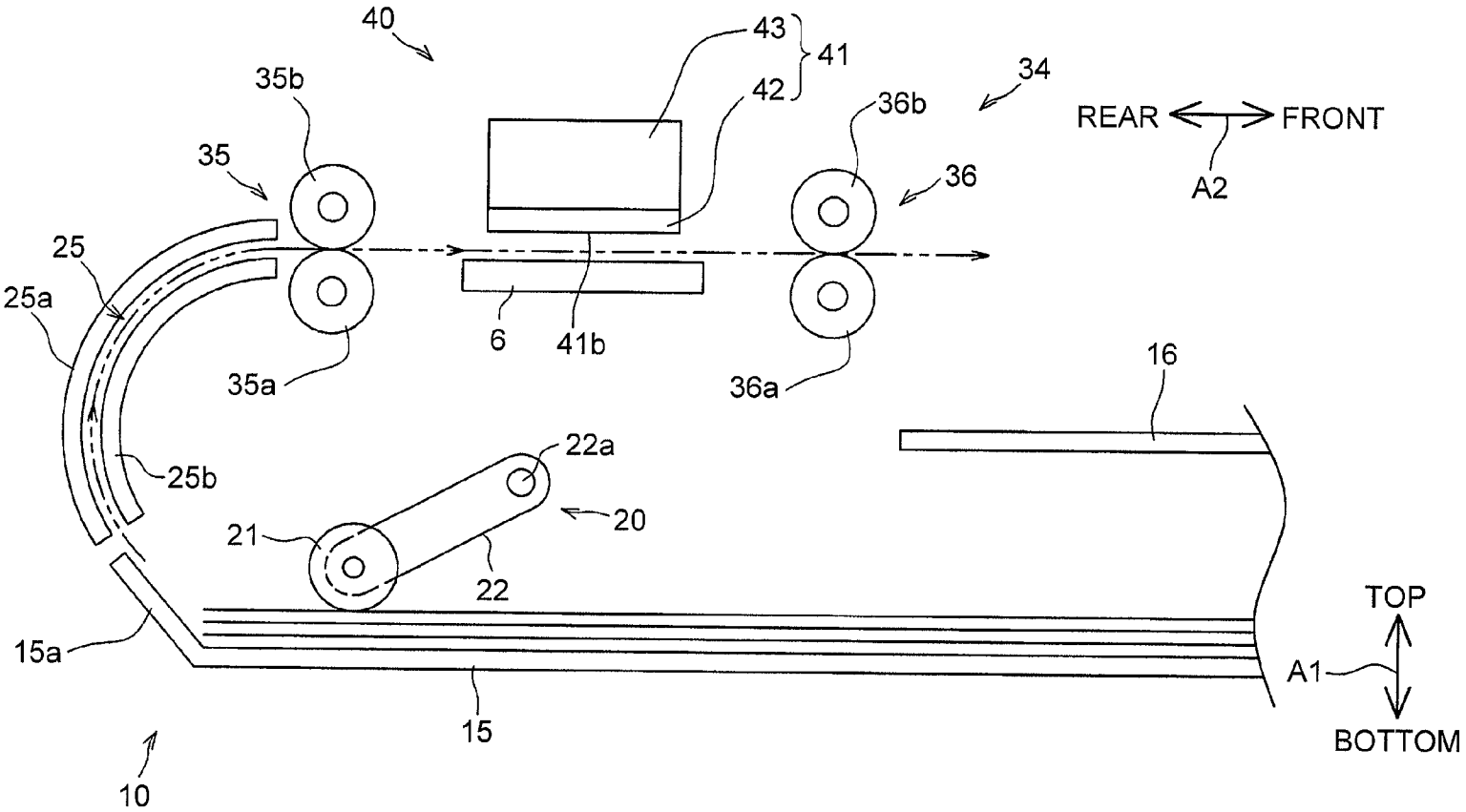
FIG. 2 is a schematic side view of the printer unit shown in FIG. 1, illustrating the internal configuration of the printer unit.
Figure 3:
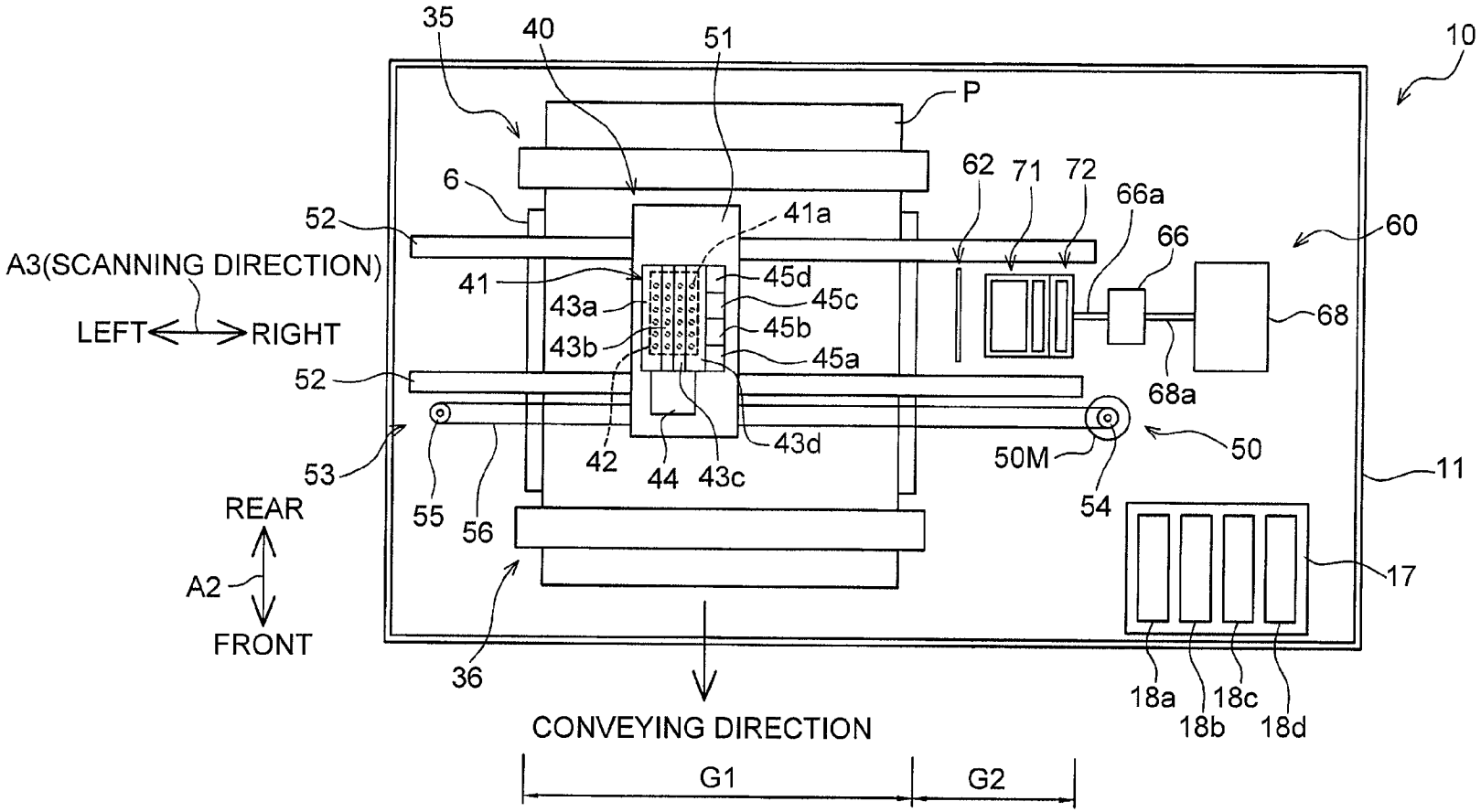
FIG. 3 is a schematic plan view of the printer unit shown in FIG. 1.

Next, the inner structure of the printer unit 10 will be described. As shown in FIGS. 2 and 3, the printer unit 10 includes a feeding unit 20, a conveying roller pair 35, a recording unit 40, a holder 17, a paper delivery roller pair 36, an auto sheet feed (ASF) motor 20M (see FIG. 10), a line feed (LF) motor 35M (see FIG. 10), a maintenance unit 60, and a control unit 5 (see FIG. 10. The feeding unit 20 feed the paper P placed on the paper feed tray 15 to a conveying path 25. The conveying roller pair 35 conveys the paper P fed by the feeding unit 20 to the recording unit 40. The recording unit 40 has a structure for, for example, an ink-jet recording system, and records an image on the paper P conveyed by the conveying roller pair 35. The paper delivery roller pair 36 delivers the paper P on which an image is recorded by the recording unit 40 to the output tray 16.

The holder 17 is disposed on the front right in the casing 11, as shown in FIG. 3. The holder 17 is detachably fitted with four ink cartridges 18*a* to 18*d*. The four ink cartridges 18*a* to 18*d* reserve ink of four colors: yellow, cyan, magenta, and black.

Feeding Unit 20

As shown in FIG. 2, the feeding unit 20 is disposed above the paper feed tray 15. The feeding unit 20 includes a paper feed roller 21 and an arm 22. The paper feed roller 21 is supported about an end of the arm 22. The arm 22 is rotatably supported by the support shaft 22*a* and is urged by a spring or the like to rotate downward so that the paper feed roller 21 comes into contact with the paper feed tray 15. The arm 22 can be retracted upward when the paper feed tray 15 is detached or attached. The paper feed roller 21 rotates when the motive force of the ASF motor 20M is transmitted via a transmission mechanism (not shown), so that the paper P stacked on the paper feed tray 15 is fed to the conveying path 25.

Paper Feed Tray 15

As shown in FIG. 2, the paper feed tray 15 has an oblique wall 15*a*. The oblique wall 15*a* guides the paper P on the paper feed tray 15, when fed by the paper feed roller 31, to the conveying path 25.

Conveying Path 25

As shown in FIG. 2, the conveying path 25 is formed of an outer guide 25*a* and an inner guide member 25*b* opposed at a predetermined interval. The conveying path 25 is curved from the rear end of the paper feed tray 15 upward and forward of the printer unit 10. The paper P fed from the paper feed tray 15 is guided upward from below by the conveying path 25 like a U-turn to reach the recording unit 40.

Conveyance Roller Pair 35 and Paper Delivery Roller Pair 36

The conveying roller pair 35 includes a lower conveying roller 35*a* and an upper pinch roller 35*b*. The pinch roller 35*b* rotates as the rotation of the conveying roller 35*a*. The conveying roller 35*a* and the pinch roller 35*b* cooperate to pinch the paper P in the vertical direction A1 and convey the paper P to the recording unit 40.

The paper delivery roller pair 36 includes a lower paper delivery roller 36*a* and an upper spur roller 36*b*. The spur roller 36*b* rotates together with the rotation of the paper delivery roller 36*a*. The paper delivery roller 36*a* and the spur roller 36*b* cooperate to pinch the paper P in the vertical direction A1 and convey the paper P to the output tray 16.

The conveying roller pair 35 and the paper delivery roller pair 36 operate as follows: when the LF motor 35M is driven, the driving force is transmitted to the conveying roller 35*a* and the paper delivery roller 36*a* by a transmission mechanism (not shown), and the conveying roller 35*a* and the paper delivery roller 36*a* rotate clockwise in FIG. 2. At that time, the conveying roller 35*a* and the paper delivery roller 36*a* are intermittently driven at a predetermined linefeed width. The rotations of the conveying roller 35*a* and the paper delivery roller 36*a* are synchronized. The rotations of the conveying roller 35*a* and the paper delivery roller 36*a* are detected by a rotary encoder (not shown) provided at the conveying roller 35*a* so that they are controlled. The paper P pinched by the conveying roller pair 35 is intermittently conveyed over a platen 6 (described below) at the predetermined linefeed width. The recording head 41 is moved to scan every line feed to record an image from the front end of the paper P. The front end of the paper P on which an image is recorded is then pinched by the paper delivery roller pair 36. Accordingly, the paper P is intermittently conveyed at a predetermined linefeed width, with the front end pinched by the paper delivery roller pair 36, and the rear end pinched by the conveying roller pair 35, on which an image is recorded by the recording head 41. When the paper P is further conveyed, the rear end of the paper P passes through the conveying roller pair 35 and is released from the pinch. Thus, the paper P is intermittently conveyed at a predetermined linefeed width while being pinched by the paper delivery roller pair 36, on which an image is similarly recorded by the recording head 41. After an image is recorded in a predetermined area of the paper P, the paper delivery roller 36*a* is continuously rotationally driven. This causes the paper P pinched by the paper delivery roller pair 36 to be discharged to the output tray 16. In this manner, the conveying mechanism 34 (see FIG. 2) for conveying the paper P according to an embodiment of the present invention is constituted by the feeding unit 20, the conveying roller pair 35, and the paper delivery roller pair 36.

Recording Unit 40

As shown in FIGS. 2 and 3, the recording unit 40 includes the recording head 41, a head moving mechanism 50, and the platen 6. The head moving mechanism 50 includes a carriage 51. The carriage 51 moves back and forth in a scanning direction (the lateral direction A3, or a direction perpendicular to the paper P conveying direction). The recording head 41 is supported by the carriage 51.

The recording head (liquid ejection head) 41 includes a head main body 42, four subtanks 43*a* to 43*d*, and four exhaust units 45*a* to 45*d*. The lower surface of the head main body 42 is an ejection surface 41*b* having a plurality of ejection ports 41*a* through which ink is ejected to the paper P conveyed below the recording head 41. As shown in FIG. 3, the plurality of ejection ports 41*a* are disposed such that four ejection port arrays along the front-to-back direction A2 are arrayed in the lateral direction A3. In this embodiment, black ink is ejected from the ejection ports 41*a* of the rightmost ejection port array in FIG. 3, and color inks (yellow, cyan, and magenta) are ejected from the ejection ports 41*a* in the other three ejection port arrays. More specifically, yellow, cyan, and magenta inks are ejected in order from the leftmost ejection port array in FIG. 3.

The four subtanks 43*a* to 43*d* are disposed side by side along the scanning direction. The four subtanks 43*a* to 43*d* are integrally provided with a tube joint 44. The four subtanks 43*a* to 43*d* and the four ink cartridges 18*a* to 18*d* are respectively connected via four flexible tubes (not shown) connected to the tube joint 44. The four subtanks 43*a* to 43*d* supply color inks to the head main body 42. The four exhaust units 45*a* to 45*d* are disposed side by side in the front-to-back direction A2 on the right of the subtank 43*d*. The exhaust units 45*a* to 45*d* respectively communicate with the four subtanks 43*a* to 43*d* to discharge bubbles built up in the subtank 43*a* to 45*d*.

The platen 6, which supports the paper P conveyed by the conveying roller pair 35, is disposed below the recording head 41. The platen 6 is disposed at a portion of the reciprocating range of the carriage 51 through which the paper P passes. The platen 6 is wider enough than the maximum width of conveyable paper P to allow the paper P conveyed on the conveying path 25 to pass through the platen 6. This area on the platen 6 is an image recording area G1.

As shown in FIG. 3, the head moving mechanism 50 includes a pair of guide rails 52 and a belt transmission mechanism 53. The pair of guide rails 52 are disposed at an interval in the front-to-back direction A2 and extends parallel to each other in the lateral direction A3. The carriage 51 is disposed across the pair of guide rails 52 and is moved back and forth in the lateral direction A3 on the pair of guide rails 52.

The belt transmission mechanism 53 includes two pulleys 54 and 55, an endless timing belt 56 and a CR motor 50M.

The two pulleys 54 and 55 are disposed at an interval in the lateral direction A3, across which the timing belt 56 is stretched. The pulley 54 is connected to the driving shaft of the CR motor 50M. Driving the CR motor 50M causes the timing belt 56 to run to move the recording head 41 in the scanning direction together with the carriage 51.

The recording head 41 ejects color inks through the ejection ports 41*a* under the control of the control unit 5. Specifically, the reciprocating motion of the carriage 51 in the lateral direction A3 causes the recording head 41 to scan across the paper P, and ejecting color inks through the ejection ports 41*a* causes an image to be recorded on the paper P conveyed on the platen 6. The printer unit 10 accommodates a linear encoder (not shown) including many translucent portions (slits) arrayed at intervals in the scanning direction. The carriage 51 is provided with a transmissive position sensor (not shown) including a light-emitting element and a photo-sensitive element. The printer unit 10 can recognize the current position in the scanning direction of the carriage 51 from the counts of the translucent portions of the linear encoder, with which the printer unit 10 controls the rotation of the CR motor 50M.

Maintenance Unit 60

The maintenance unit 60 recovers the ejection performance of the ejection ports 41*a* of the head main body 42 by forcing ink to be ejected therethrough and forces mainly bubbles to be discharged from the subtanks 43*a* to 43*d* through exhaust ports 152*a* (see FIGS. 5A and 5B) of the exhaust units 45*a* to 45*d*. The maintenance unit 60 is disposed at a maintenance position of a maintenance area G2 on the right of the image recording area G1 in the moving range of the carriage 51 in the scanning direction. The details of the maintenance unit 60 will be described later.

Next, the subtanks 43*a* to 43*d* will be described. Since the structures of the four subtanks 43*a* to 43*d* that respectively reserve inks of four colors are basically the same, one of them, a subtank 43 (sometimes denoted by reference sign 43), will be described hereinbelow.

Figure 4:
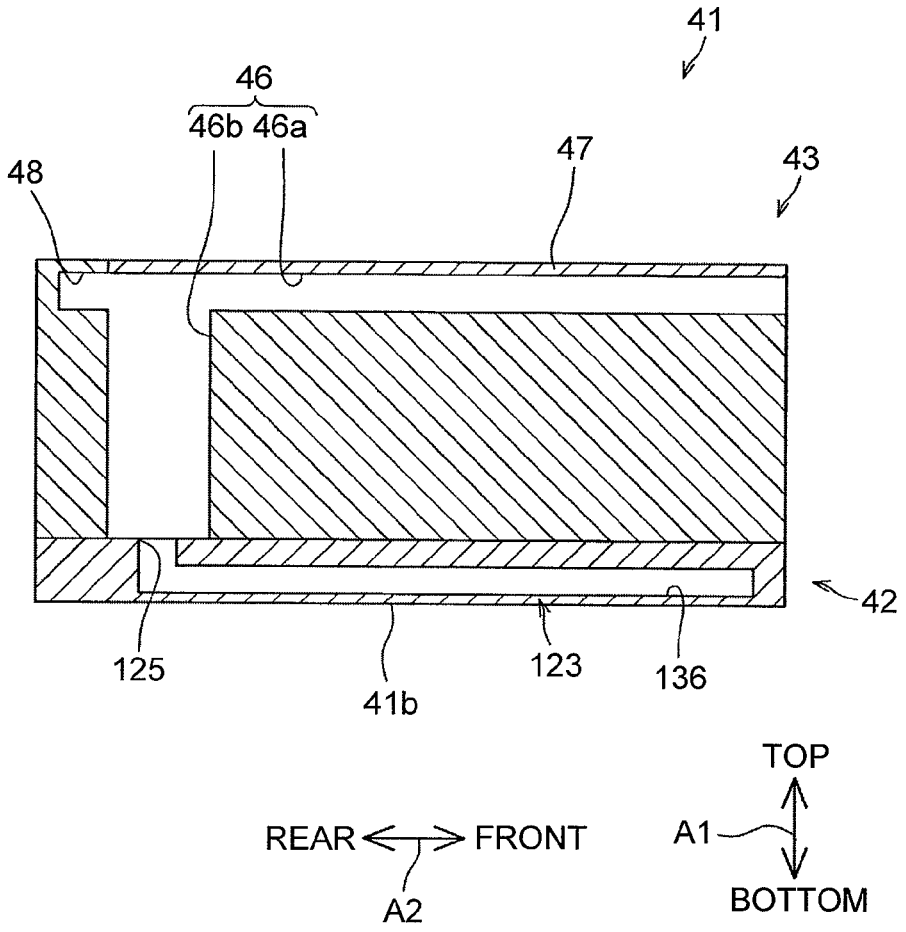
FIG. 4 is a schematic cross-sectional view of a recording head taken along a vertical line perpendicular to the lateral direction.

As shown in FIG. 4, the subtank 43 includes a channel 46 connected at one end to the tube joint 44. As shown in FIG. 4, the channel 46 (supply channel) includes a damper chamber 46*a* and a bubble reservoir 46*b*. The damper chamber 46*a* is connected to the tube joint 44 and extends in the front-to-back direction A2. The top of the damper chamber 46*a* is covered with a flexible film 47. Thus, changes in pressure generated in the ink in the channel 46 are absorbed in the damper chamber 46*a*. This reduces the possibility of transmission of the changes in pressure to the ink in a head channel 123 (described later) in the head main body 42, allowing stable ink ejection.

The bubble reservoir (a bubble reserving unit) 46*b* extends in the vertical direction A1, the upper end of which is connected to the damper chamber 46*a*, and the lower end is connected to a supply port 125 of the head main body 42. The ink in the subtank 43 flows through the damper chamber 46*a* and the bubble reservoir 46*b* to the supply port 125. Such a flow of ink causes bubbles flowing from the exterior into the channel 46 to be collected to the upper part of the bubble reservoir 46*b* and to be accumulated.

Next, the head main body 42 will be described. As shown in FIG. 4, the head main body 42 includes the head channel 123. The head channel 123 includes four supply ports 125 connecting to the individual channels 46 in the subtanks 43*a* to 43*d*, four manifolds 136 extending in the front-to-back direction A2 and respectively connecting to the supply ports 125, and a plurality of individual channels (not shown) that communicate between the individual manifolds 136 and the plurality of ejection ports 41*a*. Although FIG. 4 shows only one supply port 125 and only one manifold 136, four supply port 125 and four manifolds 136 are disposed in the lateral direction A3. The supply ports 125 and the manifolds 136 are provided for individual colors.

The head main body 42 further includes a plurality of actuators (not shown) for applying pressure to the ink in the individual channels. Driving signals are supplied from a driver IC 138 (see FIG. 10) to the actuators in response to a signal from the control unit 5, so that the pressure is applied to the ink in the individual channels, so that the ink is ejected through the ejection ports 41*a*.

Figure 5A:
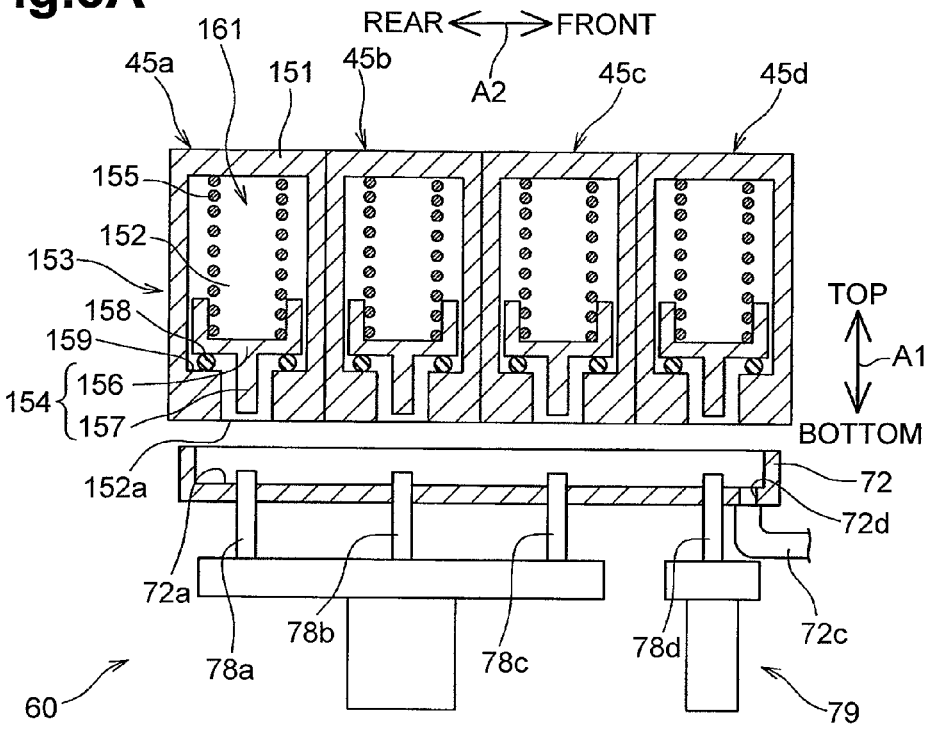
FIG. 5A is a schematic cross-sectional view of an exhaust unit, an exhaust cap of a maintenance unit, an opening and closing member, and a moving mechanism taken along the vertical line perpendicular to the lateral direction when the recording head is at a maintenance position.
Figure 5B:
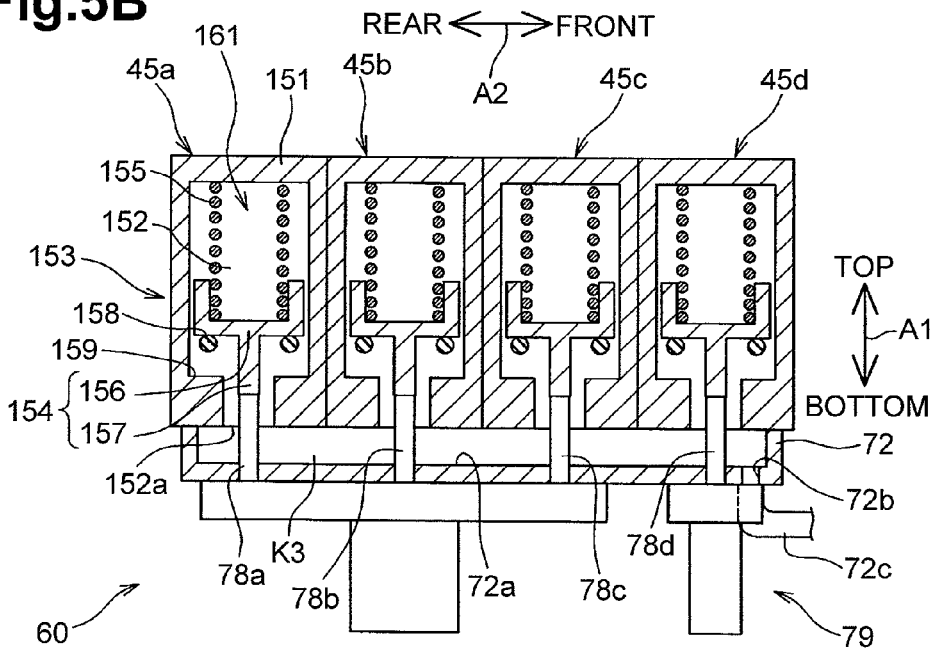
FIG. 5B is a schematic cross-sectional view of an exhaust unit, an exhaust cap of a maintenance unit, an opening and closing member, and a moving mechanism taken along the vertical line perpendicular to the lateral direction when the recording head is at a maintenance position.

Next, the exhaust units 45*a* to 45*d* will be described with reference to FIG. 3 and FIGS. 5A and 5B. As shown in FIG. 3, the exhaust units 45*a* to 45*d* are disposed on the right of the subtank 43*d*. As shown in FIGS. 5A and 5B, the four exhaust units 45*a* to 45*d* are respectively provided for the four subtanks 43*a* to 43*d* that reserve inks of four colors (yellow, cyan, magenta, and black).

Since the structures of the four exhaust units 45*a* to 45*d* for the four subtanks 43*a* to 43*d* are basically the same, one of them, an exhaust unit 45 (sometimes denoted by reference sign 45), will be described. As shown in FIGS. 5A and 5B, the exhaust unit 45 includes a case 151 fixed to the side surface of the subtank 43*d*, an exhaust channel 152 extending in the vertical direction A1 in the case 151, and an open/close valve 153 that opens and closes the exhaust channel 152. The upper end of the exhaust channel 152 connects to the upper end of the bubble reservoir 46*b* through a connecting channel 48 (see FIG. 4) communicating with the upper end of the bubble reservoir 46*b*. The exhaust channel 152 extends to the exhaust port 152*a* provided at the lower end of the case 151. The exhaust channel 152 and the connecting channel 48 constitute a communicating path 161.

The open/close valve 153 includes a valve member 154, which can be moved in the vertical direction A1 in the exhaust channel 152 and can close the exhaust channel 152, and a coil spring 155 that urges the valve member 154 downward.

The valve member 154 includes a cylindrical closed-end valve element 156 movable in the vertical direction A1 in the exhaust channel 152 and a valve stem 157 extending downward from the bottom of the valve element 156. The outside diameter of the valve element 156 is smaller than the inside diameter of the exhaust channel 152, allowing ink to flow between the valve element 156 and the inner wall surface of the exhaust channel 152. The lower surface of the valve element 156 is fitted with a ring-shaped sealing material 158, so that the valve element 156 can close the exhaust channel 152 by coming into contact with a valve seat 159 provided at an intermediate stage in the exhaust channel 152, with the sealing material 158 therebetween.

The coil spring 155 is disposed in a compressed state between the upper end of the case 151 and the valve element 156 of the valve member 154 and urges the valve member 154 downward. When the valve element 156 is driven upward by opening and closing members 78*a*, 78*b*, and 78*c*, or 78*d* (described later) against the urging force of the coil spring 155, the valve element 156 is separated from the valve seat 159 to open the exhaust channel 152.

Figure 6A:
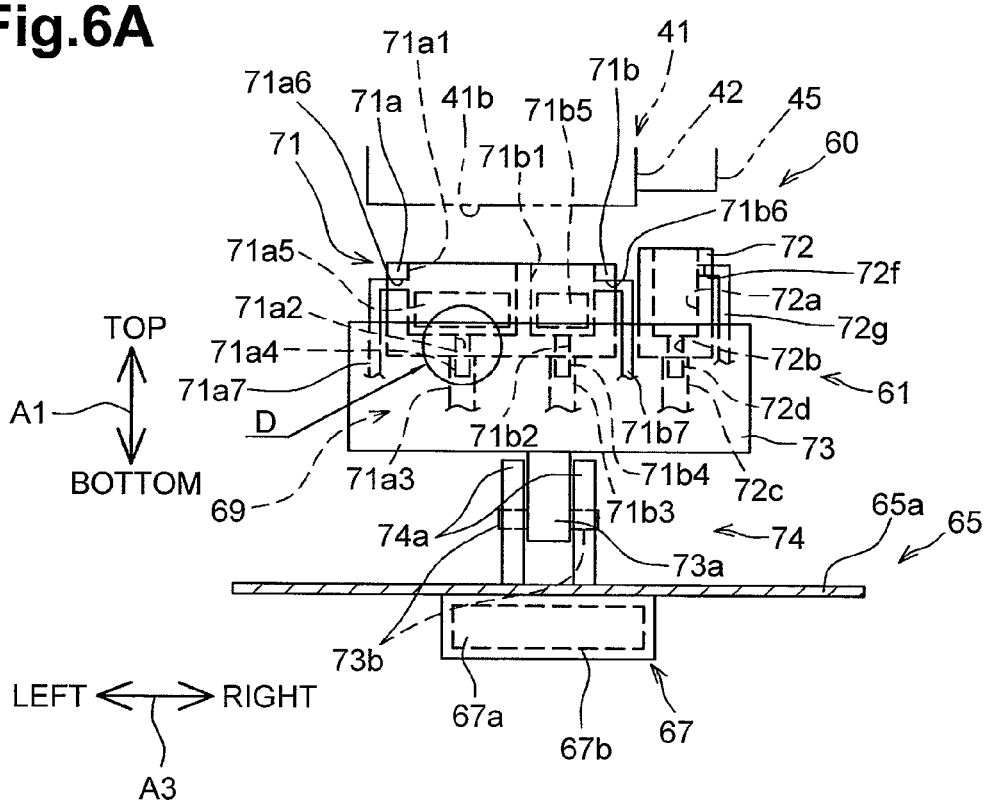
FIG. 6A is a schematic side view of the maintenance unit.

Next, the maintenance unit 60 will be described. As shown in FIG. 3 and FIGS. 5A and 5B to FIGS. 9A to 9C, the maintenance unit 60 includes a cap mechanism 61, a maintenance frame 65, a suction pump 66, a switching mechanism 67, a waste liquid tank 68, and a pump motor 66M (see FIG. 10). As shown in FIG. 6A, the maintenance frame 65 includes a flat plate 65*a* and supports the cap mechanism 61 from below.

As shown in FIGS. 5A and 5B to FIGS. 7A and 7B, the cap mechanism 61 includes a suction cap 71, an exhaust cap 72, a cap holder 73 that supports the suction cap 71 and the exhaust cap 72, a cap elevating mechanism 74 for elevating the cap holder 73, the four opening and closing members 78*a* to 78*d* for opening and closing the open/close valves 153 in the exhaust units 45*a* to 45*d*, and a moving mechanism 79 for moving the opening and closing members 78*a* to 78*d*.

Figure 6B:
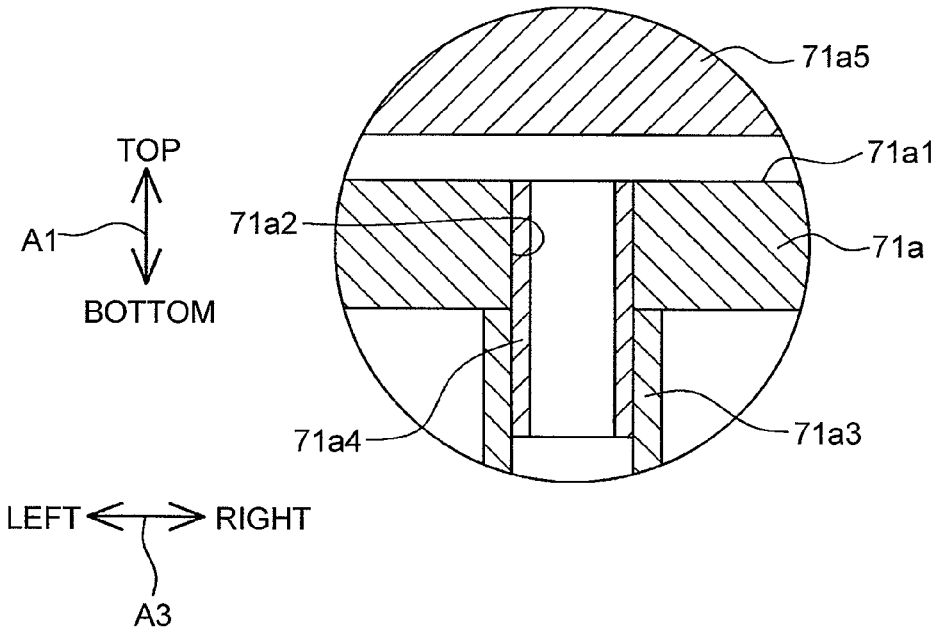
FIG. 6B is an enlarged view of a portion D in FIG. 6A.

The suction cap 71 includes a cap 71*a* having a top-open recessed portion 71*a*1 and a cap 71*b* having a top-open recessed portion 71*b*1. As shown in FIG. 6A, the two caps 71*a* and 71*b* are integrally formed of a flexible material, such as rubber and synthetic resin. The cap 71*a* has a communication hole 71*a*2 at the bottom. As shown in FIG. 6B, the communication hole 71*a*2 has a cylindrical connecting tube 71*a*4, through which a tube 71*a*3 is connected to the cap 71*a*. The cap 71*a* further has a communication hole 71*a*6 in the side wall. The communication hole 71*a*6 is connected to one end of the tube 71*a*7 through a connecting tube (not shown). The cap 71*b* also has a communication hole 71*b*2 in the bottom. The communication hole 71*b*2 also has a connecting tube 71*b*4, through which a tube 71*b*3 is connected to the cap 71*b*. The cap 71*b* further has a communication hole 71*b*6 in the side wall. The communication hole 71*b*6 is connected to one end of a tube 71*b*7 through a connecting tube (not shown). The other ends of the tubes 71*a*7 and 71*b*7 are each connected to an open/close valve 180 (see FIG. 10). The open/close valve 180 is a known open/close valve capable of switching between an open state in which the other ends of the tubes 71*a*7 and 71*b*7 communicate with the atmosphere and a closed state in which the other ends do not communicate with the atmosphere under the control of the control unit 5.

When the recording head 41 (carriage 51) has moved to a maintenance position, as indicated by the two-dot chain line in FIG. 6A, the suction cap 71 faces the ejection surface 41*b*. When the cap holder 73 is moved upward by the cap elevating mechanism 74 in this state, the suction cap 71 is brought to a contact position (described below) at which it comes into contact with the ejection surface 41*b* to cover the plurality of ejection ports 41*a* (discharge ports). At that time, when an area of the ejection surface 41*b* having the ejection ports 41*a* for ejecting inks of three colors is covered with the cap 71*a*, and when the open/close valve 180 is in the closed state, the communication between an inner space K1 in the recessed portion 71*a*1 and the atmosphere is broken (see FIG. 13A). When an area of the ejection surface 41*b* having the ejection ports 41*a* for ejecting black ink is covered with the cap 71*b*, and when the open/close valve 180 is in the closed state, the communication between an inner space K2 in the recessed portion 71*b*1 and the atmosphere is broken (see FIG. 13A).

As shown in FIG. 6A, the recessed portions 71*a*1 and 71*b*1 in the caps 71*a* and 71*b* respectively have plate-like members 71*a*5 and 71*b*5. The plate-like members 71*a*5 and 71*b*5 have a rectangular shape one size smaller than the openings of the recessed portions 71*a*1 and 71*b*1. The plate-like members 71*a*5 and 71*b*5 each have a protrusion (not shown) on the lower surfaces. The plate-like members 71*a*5 and 71*b*5 are disposed, with a minute clearance between them and the inner surfaces of the recessed portions 71*a*1 and 71*b*1. The thicknesses of the plate-like members 71*a*5 and 71*b*5 in the vertical direction A1 are smaller than the depths of the recessed portions 71*a*1 and 71*b*1 so that the plate-like members 71*a*5 and 71*b*5 are fit in the recessed portions 71*a*1 and 71*b*1. Disposing the plate-like members 71*a*5 and 71*b*5 in the recessed portions 71*a*1 and 71*b*1 allows the sucking force of the suction pump 66 to act on the clearance between the recessed portions 71*a*1 and 71*b*1 and the plate-like members 71*a*5 and 71*b*5 in an ink discharge operation (described below), allowing the ink discharge to the recessed portions 71*a*1 and 71*b*1 to be efficiently discharged.

The exhaust cap 72 has a top-open recessed portion 72*a* made of a flexible material, such as rubber and synthetic resin. The exhaust cap 72 has a communication hole 72*b* at the bottom. As shown in FIG. 5A, the communication hole 72*b* is disposed at the front end of the exhaust cap 72. As shown in FIG. 6A, the communication hole 72*b* is also provided with a connecting tube 72*d*, through which a tube 72*c* and the exhaust cap 72 are connected. The exhaust cap 72 further has a communication hole 72*f* in the side wall. The communication hole 72*f* is connected to one end of a tube 72*g* with a connecting tube (not shown). The other end of the tube 72*g* is connected to the open/close valve 180 (see FIG. 10), as the other ends of the tubes 71*a*7 and 71*b*7 are. This allows the other end of the tube 72*g* to communicate with the atmosphere when the open/close valve 180 is in the open state, and to discommunicate with the atmosphere in the closed state.

When the recording head 41 (carriage 51) has moved to the maintenance position, as indicated by the two-dot chain line in FIG. 6A, the exhaust cap 72 faces the lower surfaces of the four exhaust units 45. When the cap holder 73 is moved upward by the cap elevating mechanism 74 in this state, the exhaust cap 72 is brought to a contact position at which it comes into contact with the lower surfaces of the exhaust units 45 to cover the four exhaust ports 152*a* (discharge ports). When the open/close valve 180 is in the closed state, the communication between an inner space K3 of the recessed portion 72*a* and the atmosphere is blocked (see FIG. 5B). The cap elevating mechanism 74 is an example of a selecting mechanism according to an embodiment of the present invention.

The cap holder 73 supports the suction cap 71 and the exhaust cap 72 from below. The cap holder 73 has a downward plate-like protrusion 73*a* on the lower surface. The protrusion 73*a* has at one end a pair of protrusions 73*b* protruding in the lateral direction A3. The pair of protrusions 73*b* have a cylindrical shape.

Figure 7A:
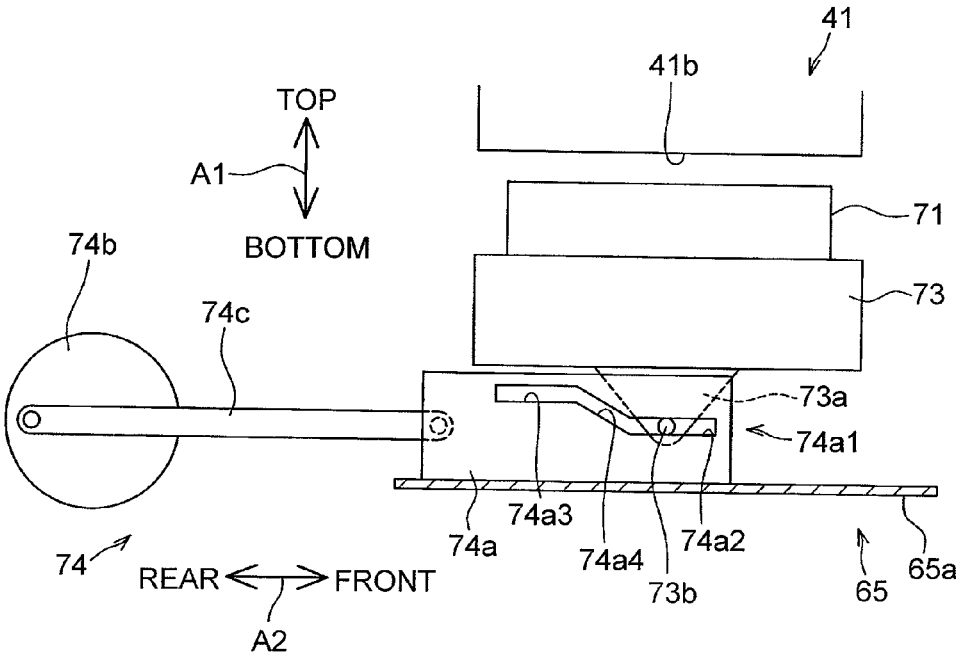
FIG. 7A is a diagram illustrating a state in which a suction cap is in a separate position.
Figure 7B:
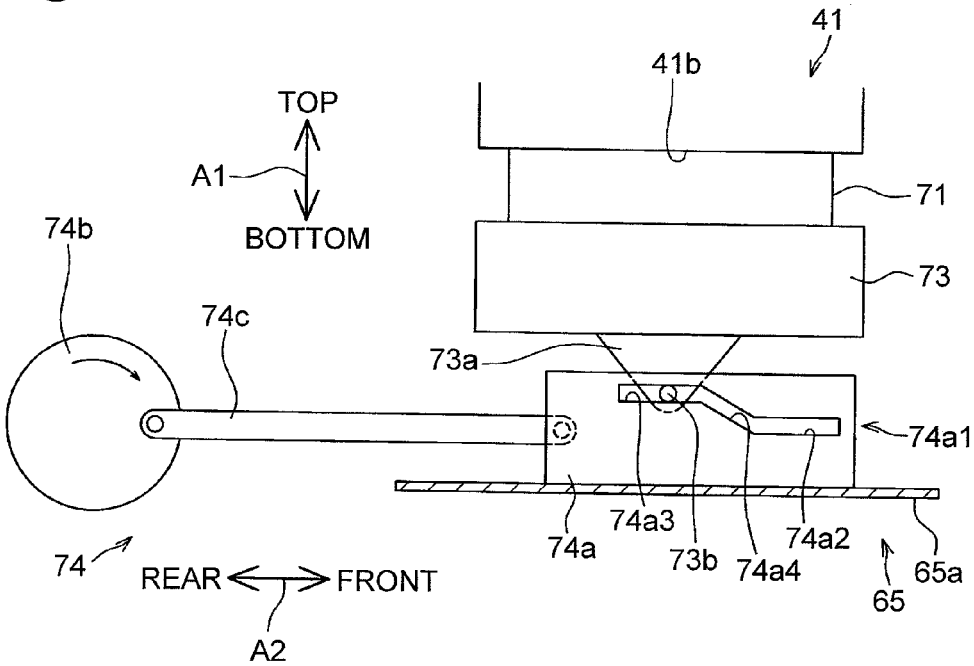
FIG. 7B is a diagram illustrating a state in which the suction cap is in a contact position.

As shown in FIGS. 6A and 7B and FIGS. 7A and 7B, the cap elevating mechanism 74 includes a pair of slide cams 74*a*, a gear 74*b*, a link 74*c* that connects the gear 74*b* and the slide cams 74*a*, and a cap elevating motor 74M (see FIG. 10) for driving the gear 74*b*. The pair of slide cams 74*a* are each formed of a plate-like member and are disposed with the protrusion 73*a* therebetween in the lateral direction A3. The pair of slide cams 74*a* vertically erect on the maintenance frame 65 so as to be slidable in the front-to-back direction A2. The pair of slide cams 74*a* are connected by a connecting member (not shown) extending in the lateral direction A3. The individual slide cams 74*a* have guide hole 74*a*1 passing in the lateral direction A3, in which the protrusions 73*b* can be disposed. The guide holes 74*a*1 each include a front portion 74*a*2, a rear portion 74*a*3, and a connecting unit 74*a*4 that connects the front portion 74*a*2 and the rear portion 74*a*3. The front portion 74*a*2 and the rear portion 74*a*3 extend horizontally in the front-to-back direction A2.

The front portion 74*a*2 is disposed lower than the rear portion 74*a*3. The connecting unit 74*a*4 therefore extends diagonally.

With the configuration of the cap elevating mechanism 74, when the slide cams 74*a* are at a rearward position, as shown in FIG. 7A, the protrusions 73*b* are disposed at the front portion 74*a*2, so that the cap holder 73 is disposed at a position closest to the maintenance frame 65. At that time, the suction cap 71 and the exhaust cap 72 are disposed at separate positions separated from the ejection surface 41*b* of the recording head 41 and the lower surface of the exhaust unit 45 disposed at the maintenance position. When the suction cap 71 and the exhaust cap 72 are disposed at the separated positions, the suction cap 71 does not cover the ejection ports 41*a*, and the exhaust cap 72 does not cover the exhaust ports 152*a*. When the cap elevating motor 74M is driven, so that the gear 74*b* rotates 180° clockwise from the position shown in FIG. 7A to the position shown in FIG. 7B, so that the pair of slide cams 74*a* connected to the link 74*c* move forward. At that time, the protrusions 73*b* are guided upward by the connecting unit 74*a*4 into the rear portion 74*a*3. When the slide cams 74*a* move to the forward position as described above, the protrusions 73*b* are disposed at the rear portion 74*a*3, so that the cap holder 73 is disposed farthest from the maintenance frame 65. At that time, the suction cap 71 and the exhaust cap 72 are disposed at contact positions at which they can come into contact with the ejection surface 41*b* of the recording head 41 and the lower surface of the exhaust unit 45. Thus, the suction cap 71 and the exhaust cap 72 cover the ejection ports 41*a* and the exhaust ports 152*a*, and when the open/close valve 180 is in the closed state, the inner spaces K1, K2, and K3 of the recessed portions 71*a*1, 71*b*1, and 72*a* and the atmosphere are discommunicated. When the open/close valve 180 is in the open state, the inner spaces K1, K2, and K3 of the recessed portions 71*a*1, 71*b*1, and 72*a* and the atmosphere communicate.

In this way, the cap elevating mechanism 74 can move the suction cap 71 and the exhaust cap 72 between the contact position and the separated position by driving the gear 74*b* with the cap elevating motor 74M. When the suction cap 71 and the exhaust cap 72 are in the contact position, the cap elevating mechanism 74 can switch the inner spaces K1, K2, and K3 of the recessed portions 71*a*1, 71*b*1, and 72*a* between the discommunicated state and the communicated state by controlling the open/close valve 180. In other words, the selecting mechanism according to an embodiment of the present invention is constituted by the cap elevating mechanism 74, the tubes 71*a*7, 71*b*7, and 72*g*, and the open/close valve 180. The position of the slide cams 74*a* in the front-to-back direction A2 can be detected on the basis of a value (the amount of rotation) output from the rotary encoder (not shown) connected to the cap elevating motor 74M. This allows the positions of the suction cap 71 and the exhaust cap 72 (the separated position or the contact position) to be controlled by controlling the position of the slide cam 74*a* in the front-to-back direction A2.

The four opening and closing members 78*a* to 78*d* (sometimes denoted by reference sign 78 for commonalities among all of the opening and closing members 78*a* to 78*d*) are rod-like members extending in the vertical direction A1, which are disposed at intervals in the front-to-back direction A2, as shown in FIGS. 5A and 5B. The opening and closing members 78 pass through the exhaust cap 72 airtightly with respect to the bottom wall so as to move up and down relative to the exhaust cap 72. When the recording head 41 has moved to the maintenance position, the opening and closing members 78 are positioned directly below the exhaust ports 152*a* in the lower surface of the corresponding exhaust units 45, as shown in FIGS. 5A and 5B.

As shown in FIGS. 5A and 5B, among the four opening and closing members 78*a* to 78*d*, the opening and closing member 78*d* corresponding to the exhaust unit 45*d* for a black ink can be independently moved in the vertical direction A1. In contrast, the three opening and closing members 78*a* to 78*c* corresponding to the exhaust units 45*a* to 45*c* for inks of three colors (yellow, cyan, and magenta) are connected together at their lower ends, so that the three opening and closing members 78*a* to 78*c* can move together in the vertical direction A1. The moving mechanism 79 includes two valve driving motors 79M1 and 79M2 (see FIG. 10) for independently moving the opening and closing members 78*a* to 78*c* for color inks and the opening and closing member 78*d* for a black ink up and down. In other words, when the valve driving motor 79M1 of the moving mechanism 79 is driven, the opening and closing members 78*a* to 78*c* move between the valve open position and the valve close position, and when the valve driving motor 79M2 of the moving mechanism 79 is driven, the opening and closing member 78*d* moves therebetween. As shown in FIG. 5A, the valve close position is a position at which the opening and closing members 78*a* to 78*d* are separated from the open/close valve 153 to close the open/close valve 153. As shown in FIG. 5B, the valve open position is a position at which the opening and closing members 78*a* to 78*d* come into contact with the open/close valve 153 to open the open/close valve 153.

The opening and closing members 78*a* to 78*d* are moved upward relative to the exhaust cap 72, with the exhaust ports 152*a* in the lower surface of the exhaust unit 45 covered with the exhaust cap 72, as shown in FIG. 5B. Then, the upper ends of the opening and closing members 78*a* to 78*d* are inserted into the exhaust channels 152 through the exhaust ports 152*a* to push the valve stems 157 in the exhaust channels 152 upward. This causes the valve elements 156 move upward together with the valve stems 157 to be separated from the valve seats 159, thus releasing the exhaust channels 152 (the valves 153 are opened). When the opening and closing members 78*a* to 78*d* move downward. The upper ends of the opening and closing members 78*a* to 78*d* are separated from the valve stems 157. This causes the valve elements 156 (the sealing members 158) to be pushed to the valve seats 159 due to the urging force of the coil springs 155, so that the exhaust channels 152 are closed.

The switching mechanism 67 is a mechanism for switching the state of connection between the suction pump 66 and the cap 71*a* for color inks, the cap 71*b* for a black ink, and the exhaust cap 72. The tube 71*a*3 connected to the cap 71*a* and a Co port 67*b*3 (described below) are connected (not shown). The tube 71*b*3 connected to the cap 71*b* and a Bk port 67*b*2 (described below) are connected (not shown). The tube 72*c* connected to the exhaust cap 72 and an exhaust port 67*b*4 (described below) are connected. As shown in FIG. 8 and FIGS. 9A to 9C, the switching mechanism 67 includes a switching member 67*a*, a cover 67*b* accommodating the switching member 67*a*, and a switching motor 67M (see FIG. 10).

The switching member 67*a* is formed of an elastic member, such as rubber, and has a cylindrical shape extending along the vertical direction A1. The switching member 67*a* rotates in a rotational direction A5 shown in FIGS. 9A to 9C by driving the switching motor 67M. The switching member 67*a* has a switching channel 67*c*. The switching channel 67*c* has a circular central groove 67*d* at the center of the upper surface of the switching member 67*a*, a vertical groove 67*e* in the peripheral surface of the switching member 67*a*, and a horizontal groove 67*f* connecting the central groove 67*d* and the vertical groove 67*e*. The vertical groove 67*e* extends in the vertical direction A1. The horizontal groove 67*f* extends horizontally from the central groove 67*d* in the radial direction of the switching member 67*a*.

Figure 8:
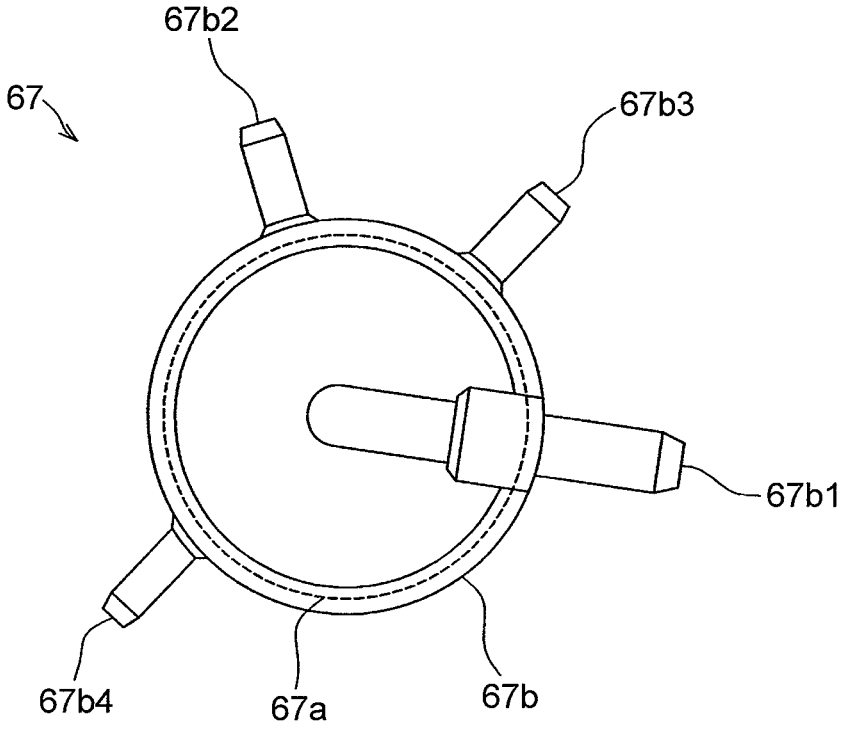
FIG. 8 is a plan view of a switching mechanism.

The cover 67*b* is a cylindrical member whose upper end and lower end are closed, in which the switching member 67*a* is disposed. The cover 67*b* is supported by the maintenance frame 65 and is rotatable relative to the switching member 67*a*. As shown in FIG. 8, the cover 67*b* has a suction port 67*b*1 at the upper end wall. The suction port 67*b*1 is connected to the suction pump 66 through a tube 66*a* (see FIG. 3). The suction port 67*b*1 is disposed at a position facing the central groove 67*d* and communicates with the central groove 67*d*. The cover 67*b* has three separate ports 67*b*2 to 67*b*4 at intervals along the rotational direction A5 on the circular peripheral wall.

The first port is a Bk port 67*b*2 communicating with a space which communicates with the cap 71*b* and to which black ink is discharged. The second port is a Co port 67*b*3 communicating with a space which communicates with the cap 71*a* and to which color inks are discharged. The third port is an exhaust port 67*b*4 communicating with a space which communicates with the exhaust cap 72 and to which bubbles in the subtanks 43*a* to 43*d* are discharged.

Figure 9A:
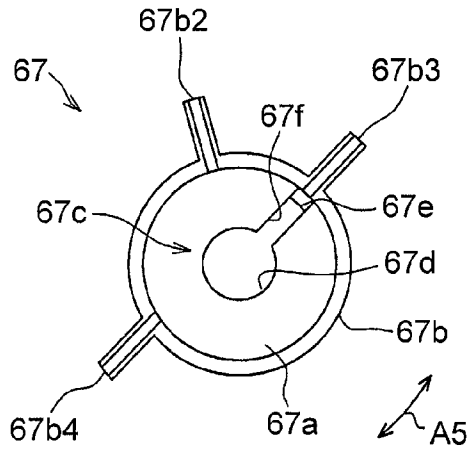
FIG. 9A is a diagram illustrating a switching member in a first state.
Figure 9B:
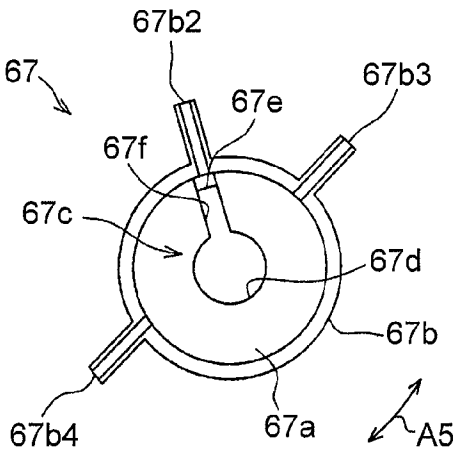
FIG. 9B is a diagram illustrating the switching member is in a second state.
Figure 9C:
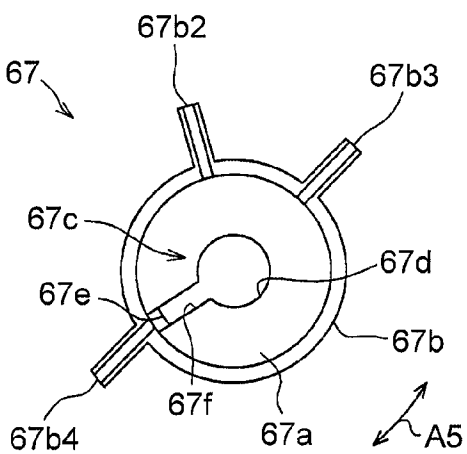
FIG. 9C is a diagram illustrating the switching member is in a third state.

The switching member 67*a* rotates when the power of the switching motor 67M is transmitted by a transmission mechanism (not shown) to switch among three states. In a first state, as shown in FIG. 9A, the suction pump 66 communicates with the Co port 67*b*3 through the switching channel 67*c*. In other words, the suction pump 66 and the tube 71*a*3 (the cap 71*a*) communicate with each other. In a second state, as shown in FIG. 9B, the suction pump 66 communicates with the Bk port 67*b*2 through the switching channel 67*c*. In other words, the suction pump 66 and the tube 71*b*3 (the cap 71*b*) communicate with each other. In a third state, as shown in FIG. 9C, the suction pump 66 communicates with the exhaust port 67*b*4 through the switching channel 67*c*. In other words, the suction pump 66 and the tube 72*c* (the exhaust cap 72) communicate with each other.

The position of the switching member 67*a* relative to the cover 67*b* in the rotational direction A5 can be controlled to switch among the first to third states of the switching mechanism 67 on the basis of the output value from the rotary encoder (not shown) connected to the switching motor 67M.

The suction pump 66 is a known tube pump, which can discharge ink and bubbles to one of the suction cap 71 and the exhaust cap 72 by rotating the rotor of the suction pump 66 when the switching member 67*a* is in one of the first to third state. The suction pump 66 rotates when the pump motor 66M (see FIG. 10) connected to the rotor is driven. The waste liquid tank 68 is connected to the suction pump 66 with a tube 68*a* and stores waste ink sucked by the suction pump 66. The three connecting tubes 71*a*4, 71*b*4, and 72*d*, the four tubes 68*a*, 71*a*3, 71*b*3, and 72*c*, and so on constitute a connecting channel 69 (see FIG. 6A) according to an embodiment of the present invention for connecting the suction cap 71 and the exhaust cap 72 to the suction pump 66 according to an embodiment of the present invention.

Figure 10:
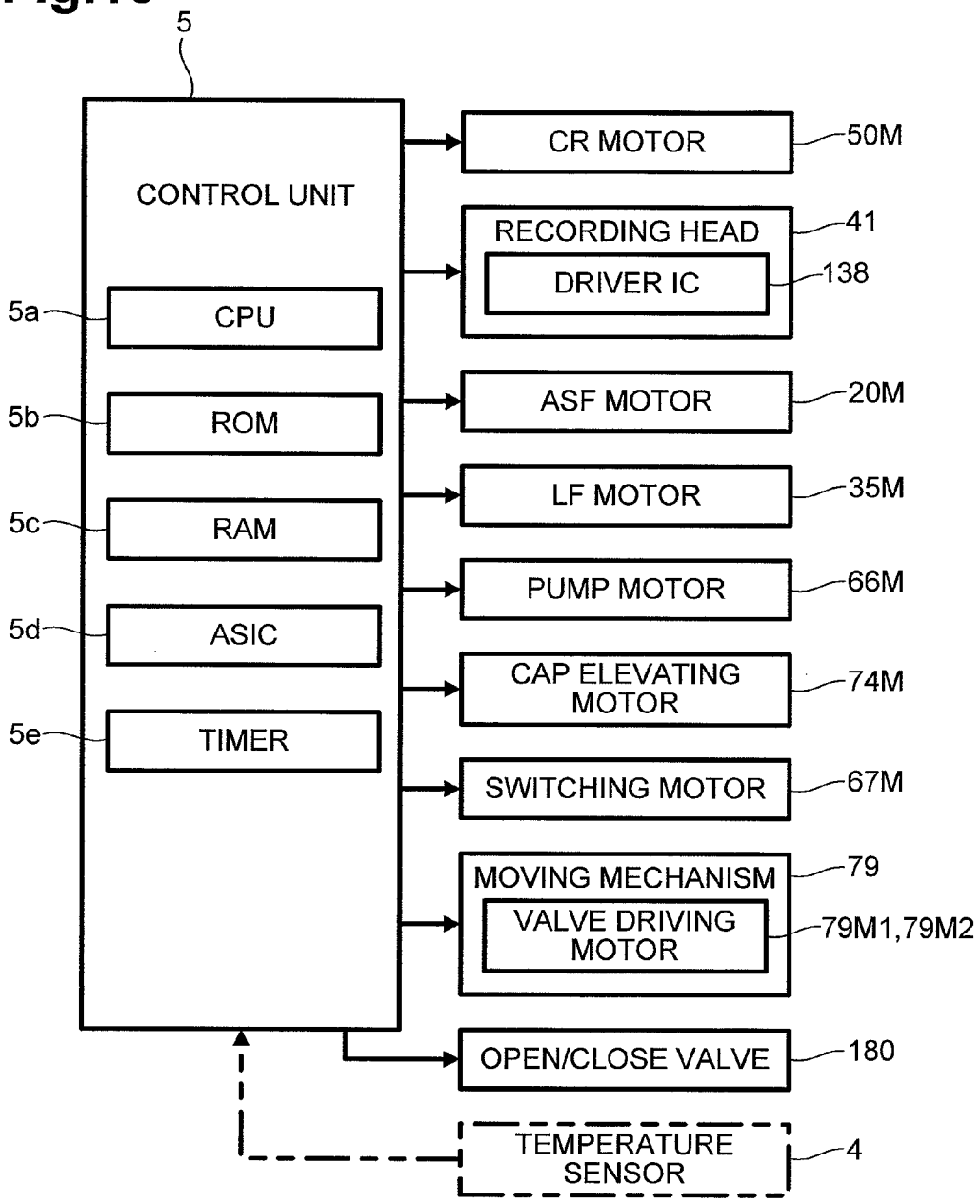
FIG. 10 is a block diagram of a control unit.

As shown in FIG. 10, the control unit 5 includes a central processing unit (CPU) 5*a*, a read only memory (ROM) 5*b*, a random access memory (RAM) 5*c*, and an application specific integrated circuit (ASIC) 5*d*, which cooperate to control the operations of the ASF motor 20M, the LF motor 35M, the CR motor 50M, the recording head 41, the pump motor 66M, the cap elevating motor 74M, the switching motor 67M, the valve driving motors 79M1 and 79M2, the open/close valve 180, and so on. The control unit 5 includes a timer 5*e* which measures a time elapsed from completion of a previous sucking process. For example, the control unit 5 controls the recording head 41, the ASF motor 20M, the LF motor 35M, the CR motor 50M, and so on in response to a record instruction transmitted from a PC to record an image on the paper P. The control unit 5 also controls the cap elevating motor 74M, the switching motor 67M, the pump motor 66M, the valve driving motors 79M1 and 79M2, the open/close valve 180, and so on to perform maintenance operations, such as an ink sucking operation for sucking ink through the ejection ports 41*a*, an exhaust operation for discharging bubbles in the subtank 43 together with ink through the exhaust ports 152*a* of the exhaust units 45, and an ink discharge operation for discharging the ink discharged in the ink sucking operation and the exhaust operation to the waste liquid tank 68. The ROM 5*b* stores first predetermined times T1 and U1, second predetermined times T2 and U2, and third predetermined times T3 and U3, described below.

Although the control unit 5 according to this embodiment includes one CPU 5*a* and one ASIC 5*d*, the control unit 5 may include only a CPU 5*a* that performs all necessary processes or may include a plurality of CPUs 5*a* that share necessary processes. The control unit 5 may include only a ASIC 5*d* that performs all necessary processes or may include a plurality of ASICs 5*d* that share necessary processes.

Figure 11:
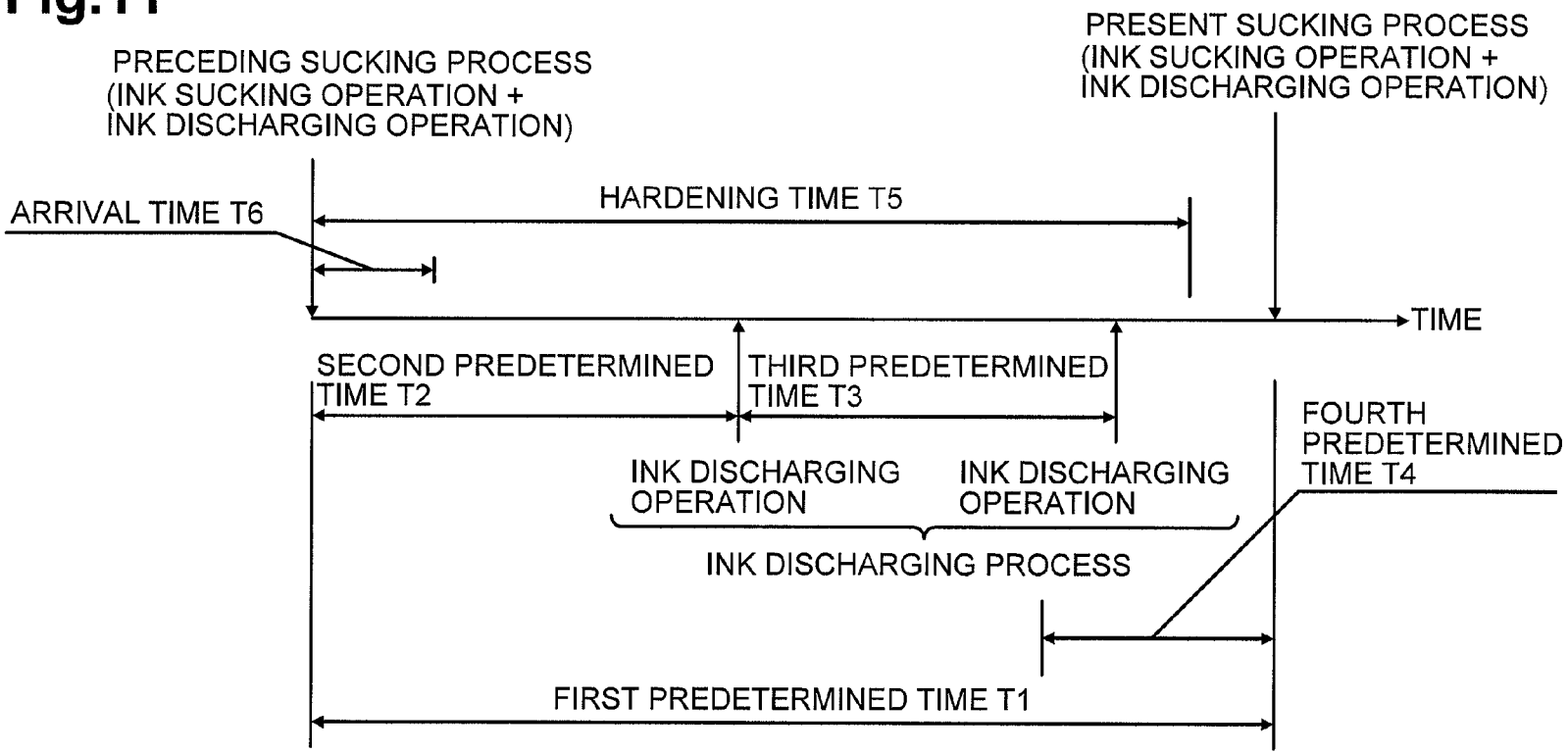
FIG. 11 is a time chart of a periodic suction maintenance operation.

Next, the maintenance operation on the printer unit 10 will be described with reference to FIGS. 11 to 16. The maintenance operation is executed in the printer unit 10 during a period of time that no image is recorded on the paper P. As shown in FIG. 11, the maintenance operation includes a periodical suction maintenance operation in which, after a lapse of a first predetermined time T1 from completion of the preceding suction process including an ink sucking operation and an ink discharge operation, a next suction process is performed. The first predetermined time T1 is a time in advance, for example, one month. In other words, the suction process is executed every month. The periodic suction maintenance operation is executed for each of a black ink and color inks. A periodic suction maintenance operation for a black ink will be described below. A periodic suction maintenance operation for color inks is substantially the same as that for the black ink, so the details will be omitted. The following description is made for a standby state in which the recording head 41 is at the maintenance position, the suction cap 71 and the exhaust cap 72 are in contact positions, and the open/close valve 180 is open, that is, in a communicating state. Since the open/close valve 180 is opened into the communicating state in the standby state, the pressure in the caps 71 and 72 can be kept under the atmospheric pressure even if the ambient temperature of the recording head 41 changes. This prevents the ink from leaking through the ejection ports 41*a* and air from entering through the ejection ports 41*a*. Since the suction cap 71 and the exhaust cap 72 are disposed at contact positions, the ink in the recessed portions 71*a*1, 71*b*1, and 72*a* are not prone to dry.

Figure 12:
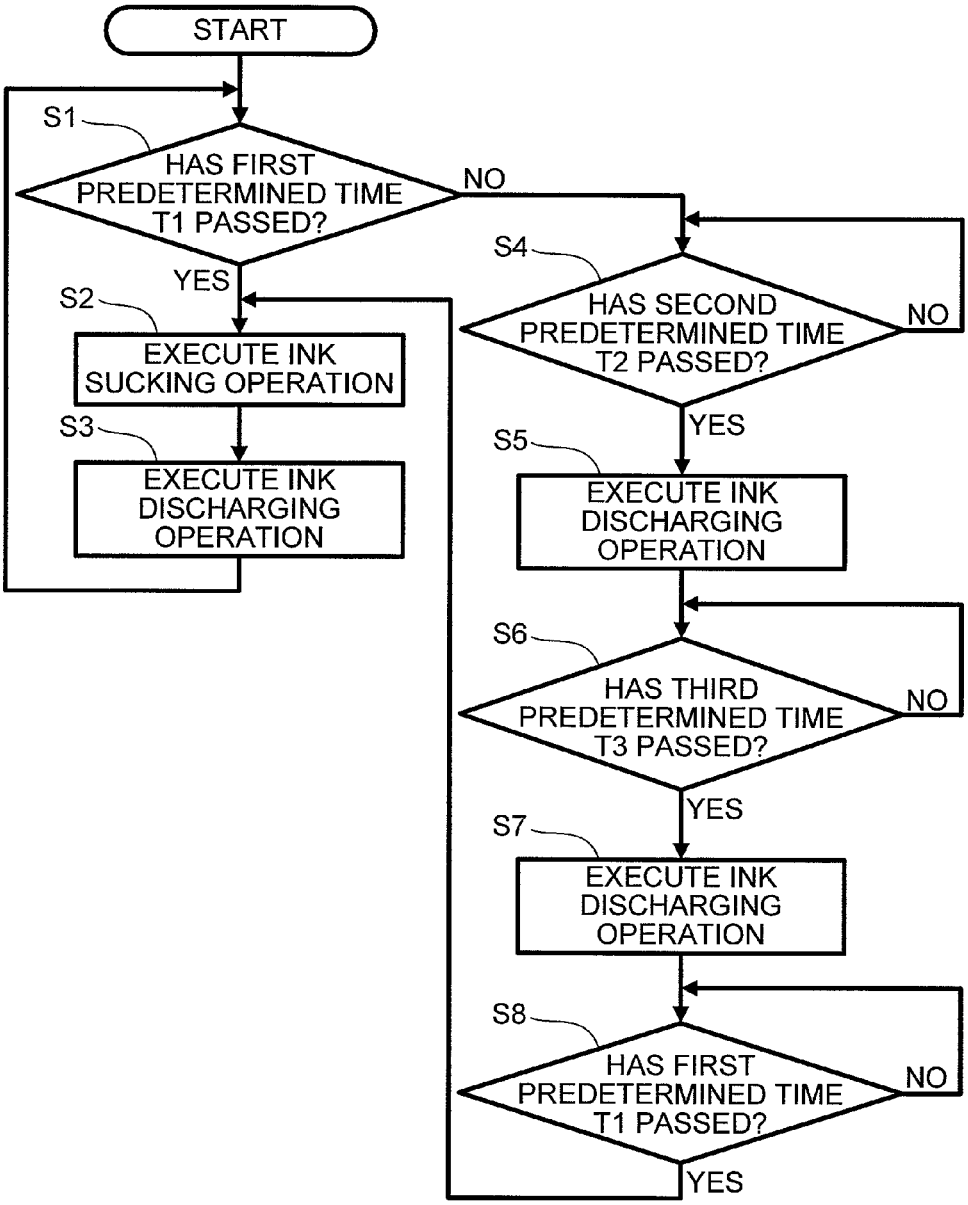
FIG. 12 is a flowchart illustrating the procedure of the periodic suction maintenance operation.

Referring to FIG. 12, in the standby state, the control unit 5 determines whether the first predetermined time T1 has passed (S1). If the first predetermined time T1 has passed (S1: YES), the control unit 5 executes the next sucking process. Specifically, the control unit 5 executes an ink sucking operation at S2, and executes an ink discharge operation at S3.

Figure 13B:
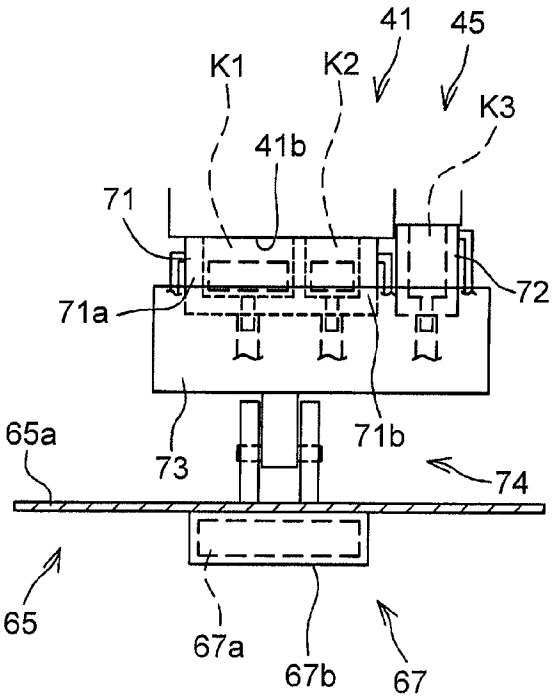
FIG. 13B is a diagram illustrating a state in which the black ink is discharged from the cap.
Figure 13A:
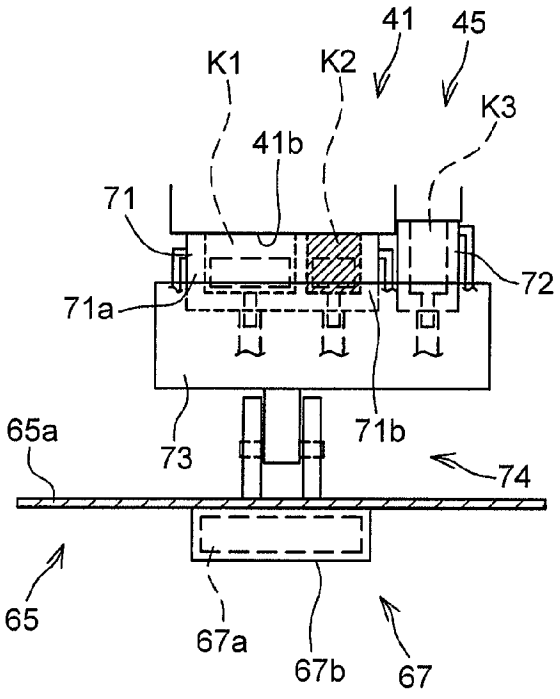
FIG. 13A is a diagram illustrating a state in which a black ink is discharged to a cap.

At S2, the control unit 5 controls the switching motor 67M to bring the switching mechanism 67 into the second state. This causes the cap 71*b* to communicate with the suction pump 66. Thereafter, the control unit 5 controls the open/close valve 180 and the pump motor 66M to bring the open/close valve 180 into the closed state and to drive the suction pump 66 for a predetermined time. This reduces the pressure in the inner space K2 of the recessed portion 71*b*1 and causes the ink to be discharged to the recessed portion 71*b*1 through the plurality of ejection ports 41*a* for a black ink, as shown in FIG. 13A. Thus, bubbles and thickened ink in the recording head 41 can be discharged to recover the ejection performance of the recording head 41. When color inks are to be discharged to the recessed portion 71*a*1 through the plurality of ejection ports 41*a* for color inks (an ink sucking operation), the switching mechanism 67 may is switched to the first state.

At S3, the control unit 5 controls the open/close valve 180 into the open state. This brings the inner space K2 in the recessed portion 71*b*1 into the communicating state in which it communicates with the atmosphere. Then the control unit 5 controls the pump motor 66M to drive the suction pump 66 for a predetermined time. This causes the ink in the recessed portion 71*b*1 to be discharged to the waste liquid tank 68, as shown in FIG. 13B. Since the recessed portion 71*b*1 accommodates the plate-like member 71*b*5, the sucking force of the suction pump 66 acts on the clearance between the recessed portion 71*b*1 and the plate-like member 71*b*5 even after most of the ink in the recessed portion 71*b*1 is discharged. This allows most of the ink in the recessed portion 71*b*1 to be discharged. The process of S3 is executed soon after the process of S2 is completed. The time after completion of the process of S2 until the process of S3 is started is therefore shorter than the third predetermined time T3, described below. This allows the ink discharge operation to be executed within a relatively short time after the ink sucking operation in the sucking process is completed. Thus, the ink remaining in the suction cap 71 can be effectively discharged. When the driving of the suction pump 66 is stopped, the process returns to S1 in the standby state. The sucking process at S2 and S3 is thus completed.

In this embodiment, an ink discharge process in which two ink discharge operations are executed is performed during a periodic sucking process, as shown in FIG. 11. First, the first ink discharge operation in the ink discharging process is executed after a lapse of the second predetermined time T2 from completion of the preceding sucking process. The second predetermined time T2 is shorter than a hardening time T5 and longer than an arrival time T6, described below. The second ink discharge operation is executed after a lapse of the third predetermined time T3 after completion of the first ink discharge operation. The third predetermined time T3 is longer than the second predetermined time T2, and the total of the time T3 and the second predetermined time T2 is shorter than the hardening time T5.

Figure 14A:
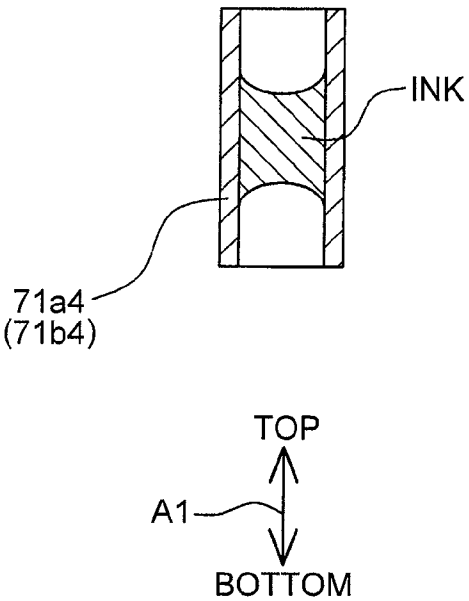
FIG. 14A is a diagram illustrating a state in which ink flowing from the suction cap remains in a connecting tube.

The arrival time T6 is the time taken for the ink remaining in the suction cap 71 to reach the communication holes 71*a*2 and 71*b*2 after completion of the ink discharge operation in the preceding sucking process. After the ink discharge operation in the sucking process is executed, most of the ink in the suction cap 71 is discharged to the waste liquid tank 68, as described above, but a little ink remains in the suction cap 71. The remaining ink moves to the communication holes 71*a*2 and 71*b*2 with the passage of time due to capillarity in the clearance between the plate-like members 71*a*5 and 71*b*5 and the recessed portions 71*a*1 and 71*b*1 and its own weight and accumulates in the connecting tubes 71*a*4 and 71*b*4, as shown in FIG. 14A. The time taken for the remaining ink to reach the connecting tubes 71*a*4 and 71*b*4 is the arrival time T6, which is obtained in advance by experiment.

Figure 14B:
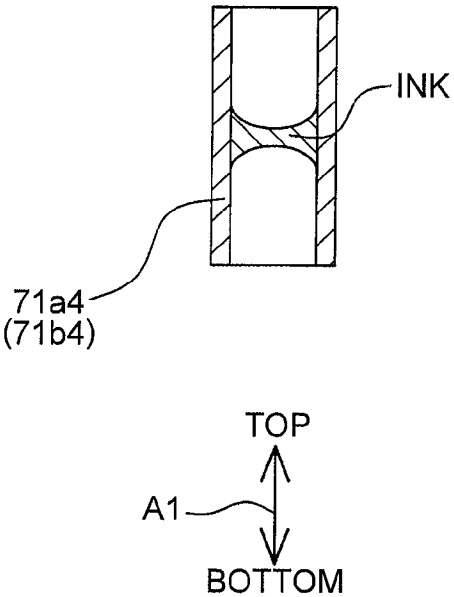
FIG. 14B is a diagram illustrating a state in which the ink in the connecting tube is hardened.
Figure 14C:
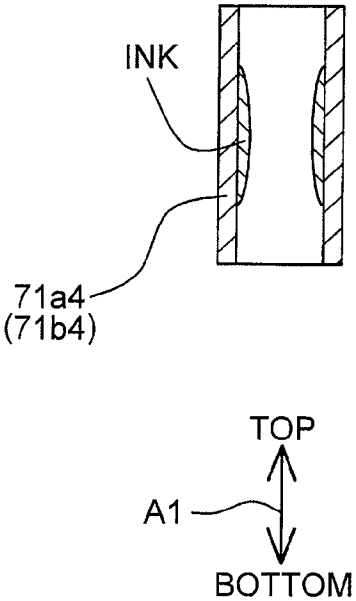
FIG. 14C is a diagram illustrating a state in which the ink remaining in the connecting tube is discharged.

The hardening time (unflowable time) T5 is the time until the ink remaining in the connecting tubes 71*a*4 and 71*b*4 is hardened, that is, the time until the ink in the connecting tubes 71*a*4 and 71*b*4 (the connecting channel 69) so increases in viscosity that the ink cannot be made flow even if the suction pump 66 is driven for an ink sucking operation. The moisture content in the ink remaining in the connecting tubes 71*a*4 and 71*b*4, shown in FIG. 14A, evaporates with the passage of time, and the ink is decreased in volume to form a stopper made of hardened ink, as shown in FIG. 14B. The time until the ink comes to such a state is the hardening time T5. In this embodiment, the hardening time T5 is obtained by measuring the time until the ink is actually hardened under the most strict environment of the temperature and humidity ranges of an assumed use environment of the multifunction device 1 (the printer unit 10).

The first predetermined time T1 is set in advance to a time equal to or longer than the hardening time T5. The second predetermined time T2 is set in advance to a time shorter than the hardening time T5 and longer than the arrival time T6 on the basis of the first predetermined time T1, the hardening time T5, and the arrival time T6. The third predetermined time T3 is set in advance to be longer than the second predetermined time T2 and such that a total time combined with the second predetermined time T2 is shorter than the hardening time T5 on the basis of the second predetermined time T2 and the hardening time T5. Thus, the ink discharging process in which two ink discharge operations are executed is executed between the preceding and this sucking processes. The third predetermined time T3 is set so that the ink discharge operation executed after the third predetermined time T3 passes is executed during a fourth predetermined time T4 back from the start of this sucking process. The fourth predetermined time T4 is shorter than the third predetermined time T3.

If at S1 the first predetermined time T1 has not passed (S1: NO), the control unit 5 determines whether the second predetermined time T2 has passed after completion of the preceding sucking process (S4). If the second predetermined time T2 has not passed (S4: NO), the control unit 5 repeats the process of S4.

In contrast, if the second predetermined time T2 has passed (S4: YES), the control unit 5 executes an ink discharge operation (S5). At that time, the switching mechanism 67 remains in the second state. The control unit 5 controls the pump motor 66M to drive the suction pump 66 for a predetermined time. This causes the ink remaining in the connecting tube 71*b*4 to be discharged to the waste liquid tank 68 into the state shown in FIG. 14C. This prevents formation of an ink-hardened stop in the connecting tube 71*b*4. To discharge the ink accumulated in the connecting tube 71*b*4, the switching mechanism 67 is brought to the first state, and the suction pump 66 is driven.

At that time, the control unit 5 controls the pump motor 66M so that it rotates at a rotational speed lower than that of the rotor of the suction pump 66. This allows the sound generated from the suction pump 66 to be smaller in volume than that at S3. When the suction pump 66 is stopped, the printer unit 10 enters the standby state.

Next, at S6, the control unit 5 determines whether the third predetermined time T3 has passed after completion of the process of S5. If the third predetermined time T3 has not passed (S6: NO), the control unit 5 repeats the process of S6.

In contrast, if the third predetermined time T3 has passed (S6: YES), then at S7 the control unit 5 executes an ink discharge operation similar to that of S5. In other words, the control unit 5 controls the pump motor 66M to drive the suction pump 66 for a predetermined time. If some ink remains at S5, it reaches the connecting tube 71*b*4 and remains there, as shown in FIG. 14A. However, the ink discharge operation is executed again at S7, so the ink is discharged to the waste liquid tank 68 into the state shown in FIG. 14C. The third predetermined time T3 is longer than the second predetermined time T2. In other words, the interval between ink discharge operations is longer at a later ink discharge operation. Since the remaining ink decreases every time the ink discharge operation is executed, clogging of the connecting tube 71*b*4 and the tube 71*b*3 is not prone to occur. Thus, setting the interval between ink discharge operations to be longer in a later operation prevents an unnecessary increase in the number of ink discharge operations executed in the ink discharging process from unnecessarily increasing.

The ink discharge operation at that time is executed during the fourth predetermined time T4 back from the start of this sucking process. This allows the ink discharge operation to be executed during the relatively short fourth predetermined time T4 before this sucking process is executed. This can prevents the connecting tube 71*b*4 and the tube 71*b*3 from being clogged with ink, improving the reliability of this sucking process.

At that time, the control unit 5 controls the pump motor 66M so that the suction pump 66 is driven for a short time while rotating the pump motor 66M at the same rotational speed as that of the rotor of the suction pump 66 at S5. This can prevent the suction pump 66 from being unnecessarily driven, with a little ink remaining in the connecting tube 71*b*4 and the tube 71*b*3, thereby reducing the time during which sound is generated from the suction pump 66. When driving of the suction pump 66 is stopped, the recording unit 40 enters a standby state. Thus, the ink discharging process of S5 and S7 is completed.

Next, at S8, the control unit 5 determines whether the first predetermined time T1 has passed, as at S1. If the first predetermined time T1 has not passed (S8: NO), the control unit 5 repeats the process of S8. In contrast, if the first predetermined time T1 has passed (S8: YES), the control unit 5 goes to S2.

The processing of the periodic suction maintenance operation thus constitutes the loop from S3 back to S1. However, whether a sucking process is executed in accordance with an instruction from the operator is always monitored, so if the sucking process is executed, the processing in FIG. 12 returns to the start, and the process of S1 is executed.

Figure 15:
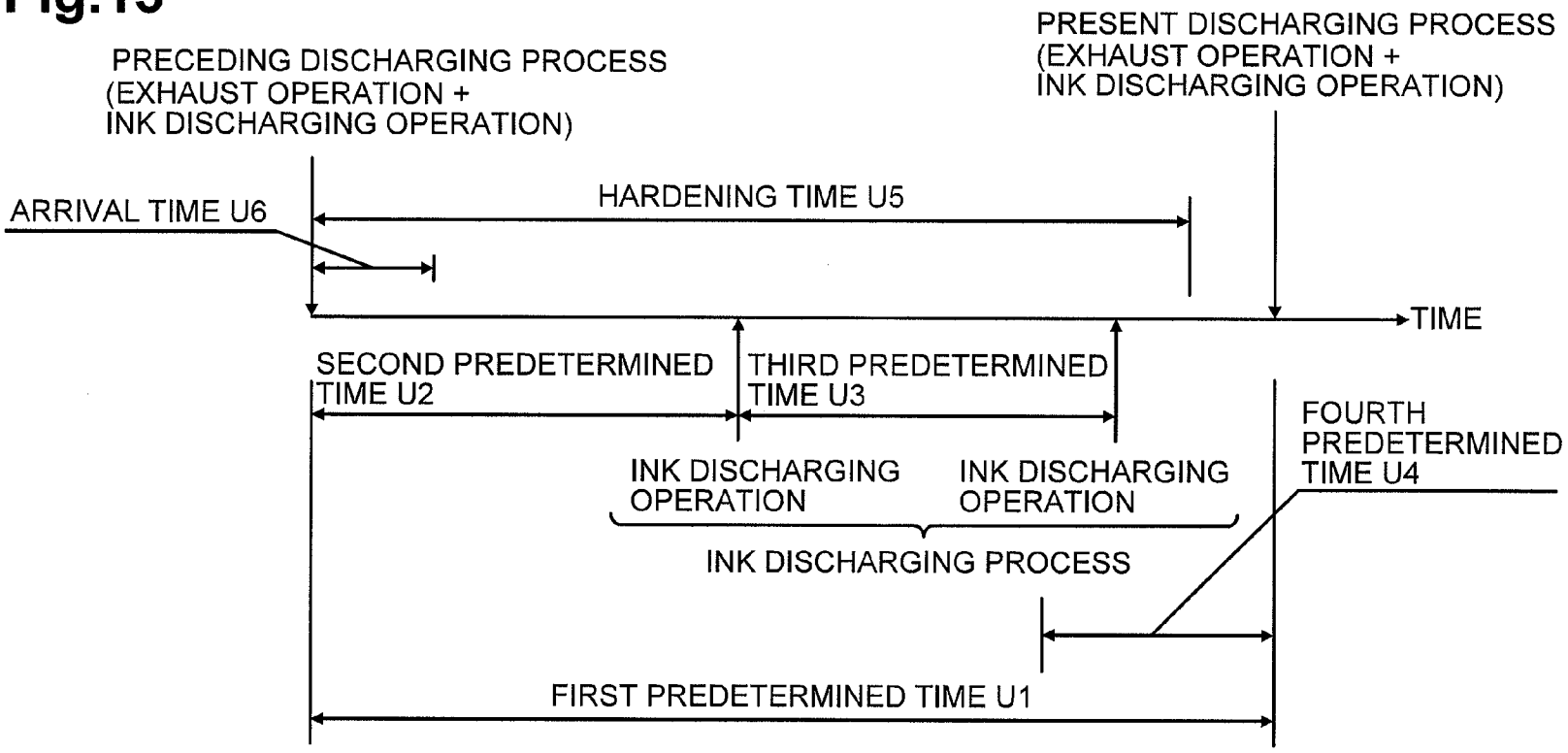
FIG. 15 is a time chart of a periodic exhaust maintenance operation.

As shown in FIG. 15, the maintenance operation further includes a periodic exhaust maintenance operation in which, after a lapse of a first predetermined time U1 from completion of the preceding exhaust process including an exhaust operation and an ink discharge operation, the next exhaust process is performed. The first predetermined time U1 is a time determined in advance, which is longer than the first predetermined time T1 described above. The periodic exhaust maintenance operation is also executed for each of a black ink and color inks. A periodic exhaust maintenance operation for a black ink will be described below. A periodic exhaust maintenance operation for color inks is substantially the same as that for the black ink, so the details will be omitted. The following description is made for the standby state in which the recording head 41 is at the maintenance position, the suction cap 71 and the exhaust cap 72 are in contact positions, and the open/close valve 180 is open, that is, in the communicating state.

Figure 16:
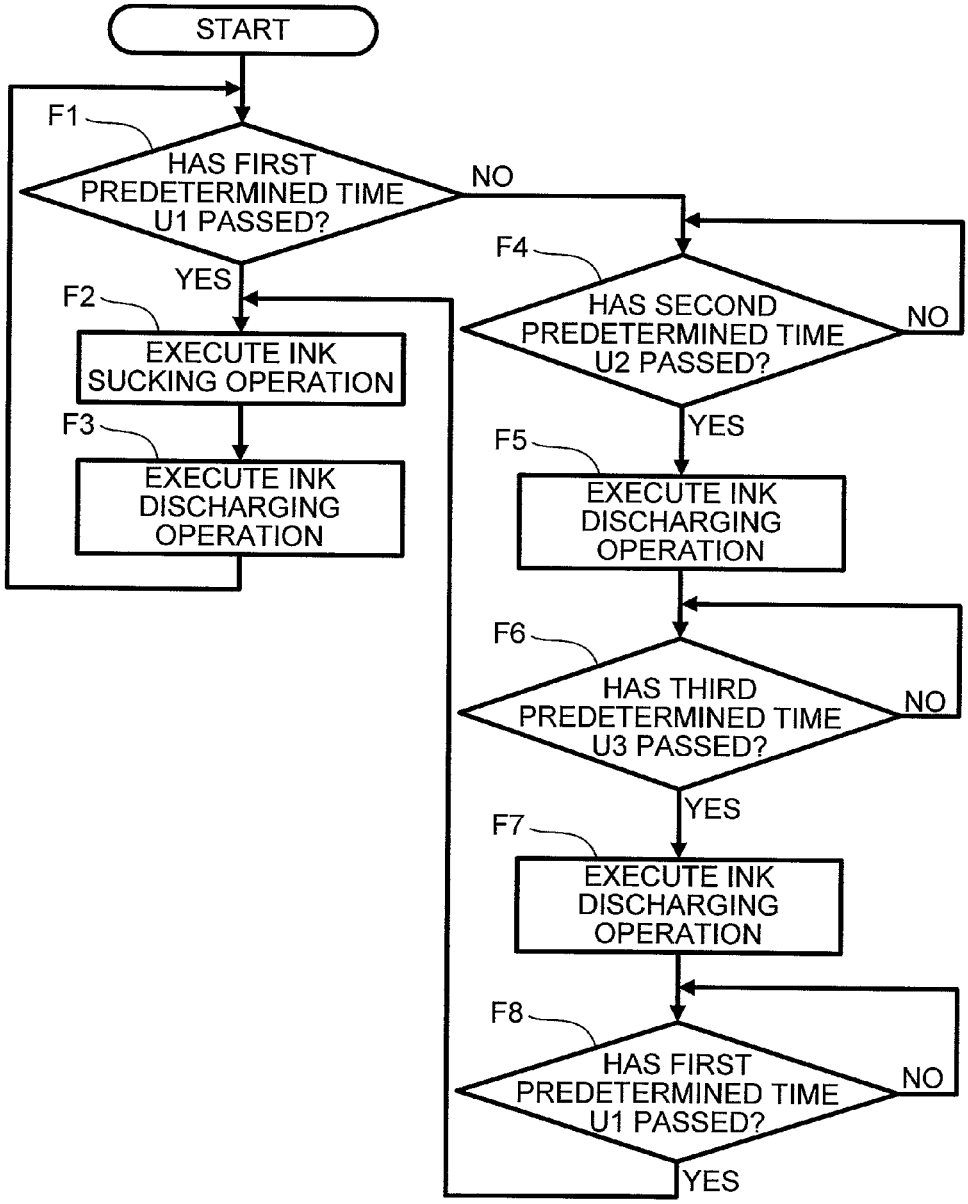
FIG. 16 is a flowchart illustrating the procedure of the periodic exhaust maintenance operation.

As shown in FIG. 16, in the standby state, the control unit 5 determines whether the first predetermined time U1 has passed (F1). If the first predetermined time U1 has passed (F1: YES), the control unit 5 executes the next exhaust process. Specifically, the control unit 5 executes an exhaust operation at F2 and executes an ink discharge operation at F3.

At F2, the control unit 5 controls the switching motor 67M to bring the switching mechanism 67 into the third state. This causes the exhaust cap 72 and the suction pump 66 to communicate with each other. Thereafter, the control unit 5 controls the open/close valve 180, the valve driving motor 79M2, and the pump motor 66M to bring the open/close valve 180 into the closed state, move the opening and closing member 78*d* from the valve close position to the valve open position, and then drive the suction pump 66 for a predetermined time. This causes the inner space K3 in the recessed portion 72*a* to be decreased in pressure, so that bubbles in the bubble reservoir 46*b* of the subtank 43*d* are discharged together with ink to the recessed portion 72*a* through the exhaust ports 152*a*. To discharge the bubbles in the subtank 43*a* to 43*c* (an exhaust operation), the opening and closing members 78*a* to 78*c* are moved from the valve close position to the valve open position by controlling the valve driving motor 79M1.

At F3, the control unit 5 controls the open/close valve 180 and the valve driving motor 79M2 to bring the open/close valve 180 to the open state, and to close the exhaust channel 152 of the exhaust unit 45*d*. This brings the inner space K3 in the recessed portion 72*a* into the communicating state in which it communicates with the atmosphere. The control unit 5 then controls the pump motor 66M to drive the suction pump 66 for a predetermined time. This causes the ink in the recessed portion 72*a* to be discharged to the waste liquid tank 68. The process of F3 is executed soon after completion of the process of F2. For this reason, the time from the completion of the process of F2 to the start of the process of F3 is shorter than the third predetermined time U3, described below. This allows an ink discharge operation to be executed within a relatively short time after completion of the exhaust operation in the exhaust process. This allows the ink remaining in the exhaust cap 72 to be effectively discharged. When the driving of the suction pump 66 is stopped, the process returns to F1 in the standby state. The exhaust process at F2 and F3 is thus completed.

As shown in FIG. 15, an ink discharging process in which two ink discharge operations are executed is performed also during a period of periodic exhaust process, as described above. The first ink discharge operation in the ink discharging process is executed after a lapse of the second predetermined time U2 from completion of the preceding exhaust process. The second predetermined time U2 is substantially the same as the second predetermined time T2 and is set to shorter than a hardening time (unflowable time) U5, described below, and be longer than an arrival time U6. The second ink discharge operation is executed after a lapse of the third predetermined time U3 from completion of the first ink discharge operation. The third predetermined time U3 is also substantially the same as the third predetermined time T3 and is set to be longer than the second predetermined time U2, and such that a total time combined with the second predetermined time U2 is shorter than the hardening time U5. The hardening time U5 can be obtained by actual measurement as the hardening time T5 is. The arrival time U6 can be obtained by experiment in advance, although a little different from the arrival time T6 because of the shape of the cap and not having the plate-like members 71*a*5 and 71*b*5.

If at F1 the first predetermined time U1 has not passes (F1: NO), the control unit 5 determines whether the second predetermined time U2 has passed after completion of the preceding exhaust process (F4). If the second predetermined time U2 has not passed (F4: NO), the control unit 5 repeats the process of F4.

In contrast, if the second predetermined time U2 has passed (F4: YES), then at F5 the control unit 5 executes an ink discharge operation similar to that of S5. At that time, the switching mechanism 67 remains in the third state. The control unit 5 controls the pump motor 66M to drive the suction pump 66 for a predetermined time. This causes the ink remaining in the connecting tube 72*d* to be discharged to the waste liquid tank 68, as with the connecting tube 71*b*4, described above. This can prevent formation of an ink-hardened stop in the connecting tube 72*d*. As at S5, the sound generated from the suction pump 66 is smaller in volume that at F3. When the suction pump 66 is stopped, the printer unit 10 enters the standby state.

Next, at F6, the control unit 5 determines whether the third predetermined time U3 has passed after completion of the process of F5. If the third predetermined time U3 has not passed (F6: NO), the control unit 5 repeats the process of F6.

In contrast, if the third predetermined time U3 has passed (F6: YES), then at F7 the control unit 5 executes an ink discharge operation similar to that of S7. Specifically, the control unit 5 controls the pump motor 66M to drive the suction pump 66 for a predetermined time. This can prevent formation of an ink-hardened stop in the connecting tube 72*d*. The third predetermined time U3 is longer than the second predetermined time U2. This can prevent an unnecessary increase in the number of ink discharge operations executed in the ink discharging process. Furthermore, this exhaust maintenance operation can prevent the suction pump 66 from being unnecessarily driven, with a little ink remaining in the connecting tube 72*d*, thereby reducing the time during which sound is generated from the suction pump 66. When driving of the suction pump 66 is stopped, the printer unit 10 enters a standby state. Thus, the ink discharging process of F5 and F7 is completed.

Next, at F8, the control unit 5 determines whether the first predetermined time U1 has passed as at S8. If the first predetermined time U1 has not passed (F8: NO), the control unit 5 repeats the process of F8. In contrast, if the first predetermined time U1 has passed (F8: YES), the control unit 5 goes to F2.

The processing of the periodic suction maintenance operation thus constitutes the loop from F3 back to F1. However, whether an exhaust process is executed in accordance with an instruction from the operator is always monitored, so if the exhaust process is executed, the processing in FIG. 16 returns to the start, and the process of F1 is executed.

As described above, the printer unit 10 according to this embodiment executes an ink discharging process in which two ink discharge operations are performed between two adjacent sucking processes in a periodic suction maintenance operation. The ink discharge operations in the ink discharging process are performed during the hardening time T5 during which ink is hardened in the connecting tubes 71*a*4 and 71*b*4 (the connecting channel 69). The collected ink is dried into a solid with time, thereby preventing the connecting tubes 71*a*4 and 71*b*4 from being clogged. This increases the reliability of execution of the ink sucking operation in the sucking process. If ink is accumulated not only in the connecting tubes 71*a*4 and 71*b*4 but also in the tubes 71*a*3 and 71*b*3, the hardening times T5 in the connecting tubes 71*a*4 and 71*b*4 and the tubes 71*a*3 and 71*b*3 may be individually measured, and a shorter time is employed as the hardening time T5. This can prevent ink from being dried to clog not only the connecting tubes 71*a*4 and 71*b*4 but also the tubes 71*a*3 and 71*b*3.

The first ink discharge operation at S6 is executed after a lapse of the arrival time T6. Thus, the ink discharge operation is performed after the ink remaining in the suction cap 71 reaches the connecting tubes 71*a*4 and 71*b*4. This can effectively prevent the connecting tubes 71*a*4 and 71*b*4 from being clogged.

An ink discharging process in which two ink discharge operations are performed is performed between two adjacent exhaust processes in a periodic exhaust maintenance operation. The ink discharge operations in the ink discharging process are performed during the hardening time U5 during which ink is hardened in the connecting tube 72*d* (the connecting channel 69). The collected ink is dried into a solid with time, thereby preventing the connecting tube 72*d* from being clogged. This increases the reliability of execution of the exhaust operation in the exhaust process. If ink is accumulated not only in the connecting tube 72*d* but also in the tube 72*c*, the hardening times T5 in the connecting tubes 72*d* and the tube 72*c* may be individually measured, and a shorter time is employed as the hardening time U5. This can prevent ink from being dried to clog not only the connecting tube 72*d* but also the tube 72*c*.

In the above embodiment, the times for executing ink discharge operations in the ink discharging process (the second predetermined times T2 and U2 and the third predetermined times T3 and U3) are stored in advance. Alternatively, the hardening times T5 and U5 may be derived, and the second predetermined times T2 and U2 and the third predetermined times T3 and U3 may be determined on the basis of the hardening times T5 and U5. In this modification, the printer unit 10 includes a temperature sensor 4 connected to the control unit 5, as indicated by the two-dot chain line in FIG. 10. The temperature sensor 4 is disposed in the casing 11 and detects the temperature in the printer unit 10. The ROM 5*b* in the control unit 5 of this modification stores in advance the water-vapor transmission coefficient of the connecting channel 69, the thicknesses of portions in which ink is accumulated, data indicating the relationship between the water evaporation rate of ink and the viscosity of the ink, and the threshold value of the viscosity of the ink. The ROM 5*b* also stores the first predetermined times T1 and U1. The portions in which ink is accumulated in this embodiment are the connecting tubes 71*a*4, 71*b*4, and 72*d*. The thickness is therefore the total thickness of the connecting tubes 71*a*4, 71*b*4, and 72*d* and the tubes 71*a*3, 71*b*3, and 72*c*. The connecting tubes 71*a*4, 71*b*4, and 72*d* have the same thickness. The tubes 71*a*3, 71*b*3, and 72*c* also have the same thickness. If the connecting tubes 71*a*4, 71*b*4, and 72*d* have different thicknesses, or the tubes 71*a*3, 71*b*3, and 72*c* have different thicknesses, the smallest thickness may be employed. This allows short hardening times T5 and U5 to be derived.

Figure 17:
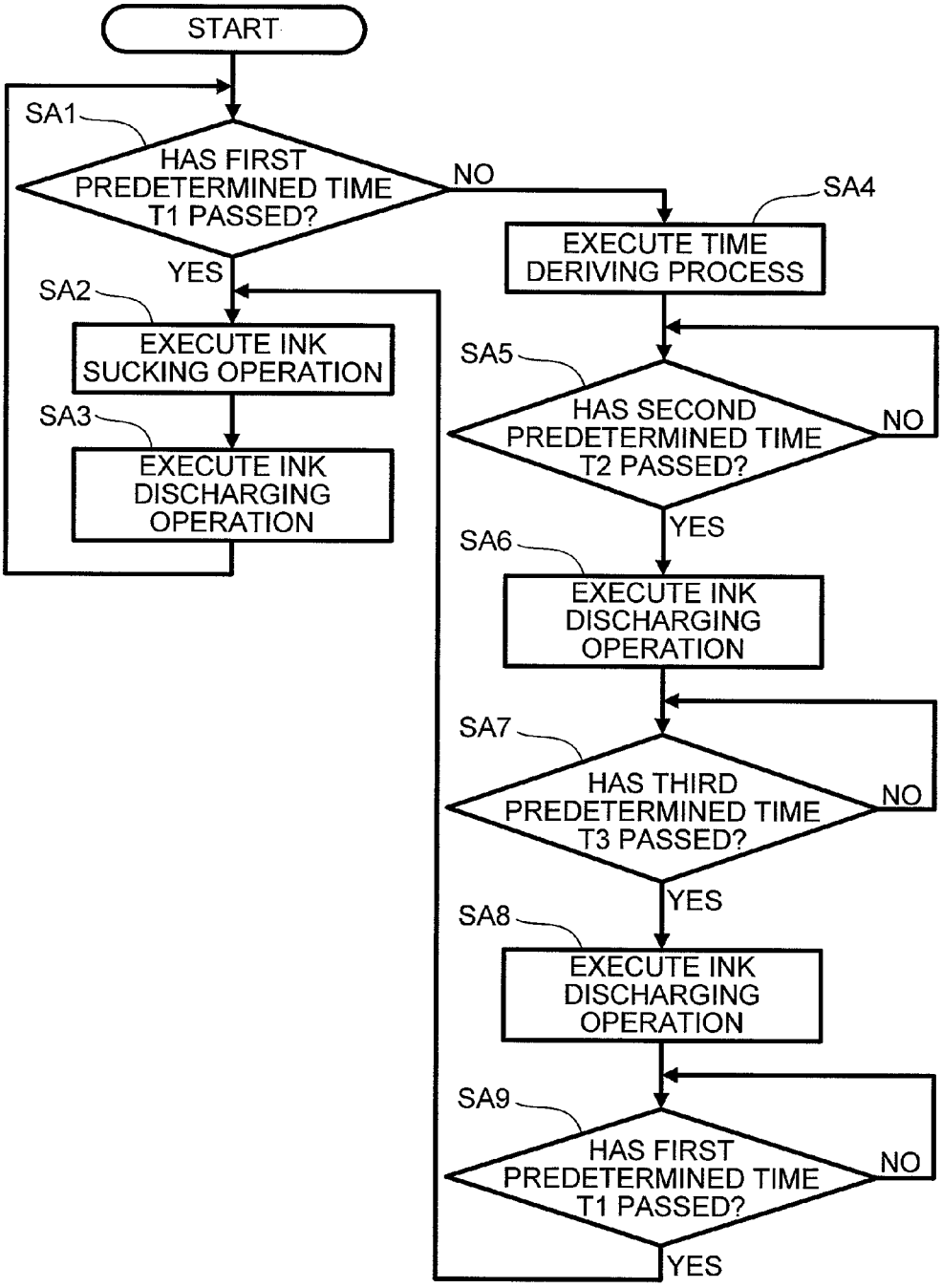
FIG. 17 is a flowchart illustrating the procedure of a periodic suction maintenance operation according to a modification of an embodiment of the present invention.

In a periodic suction maintenance operation of this modification, processes from SA1 to SA3 similar to those at S1 to S3 in the above embodiment are executed, as shown in FIG. 17. If at SA1 the first predetermined time T1 has not passed (SA1: NO), the control unit 5 executes a time deriving process (SA4).

After completion of the preceding sucking process, then at SA4 the control unit 5 calculates the hardening time T5 of ink partly remaining in the connecting channel 69. Specifically, the control unit 5 derives the hardening time T5 on the basis of a temperature detected by the temperature sensor 4, the water-vapor transmission coefficient, the thickness of the portion at which the ink is accumulated, data indicating the relationship between the water evaporation rate and the viscosity of the ink, and the threshold value of the viscosity of the ink. A relational expression for use in deriving the hardening time T5 in the time deriving process is stored in advance in the ROM 5*b*. An effect of a change in humidity on the hardening time T5 is extremely smaller than the effect of a change in temperature under an environment in which the multifunction device 1 is actually used. Therefore, sufficiently accurate hardening time T5 can be obtained on the basis of the temperature without detecting the humidity.

Specifically, the control unit 5 calculates the water evaporation rate of the ink from the initial weight of the ink and the evaporation speed of ink partly remaining in the connecting channel on the basis of the temperature detected by the temperature sensor 4. The initial ink weight is obtained by weighing ink partly remaining in the connecting tubes 71*a*4 and 71*b*4 after completion of ink discharge operations in the sucking process, obtained by experiment and is stored in advance in the ROM 5*b*. The water evaporation rate of the ink at time t1 at which time t1 has passed from sucking-process end time t0 (an ink weight at time t1/an initial ink weight at time t0) can be calculated from the initial ink weight and an accumulated water evaporation rate from time t0 to time t1). The accumulated water evaporation rate can be calculated from the evaporation speed of water in the ink that depends on the ambient temperature detected by the temperature sensor 4. The water evaporation speed is inversely proportional to the thicknesses of the portions at which the ink remains (here, the total thickness of the connecting tubes 71*a*4 and 71*b*4 and the tubes 71*a*3 and 71*b*3) and is proportional to the water-vapor transmission coefficient of the material of the portions. Accordingly, if the ambient temperature, the thicknesses of the portions at which the ink remains, and the water-vapor transmission coefficient of the material of the portions (and also the two coefficients) are known, the water evaporation rate of the ink at time t1 can be calculated. Furthermore, the ink viscosity at time t1 can be derived from the calculated water evaporation rate of the ink and a relational expression of the ink viscosity and the water evaporation rate of the ink, which is obtained by measurement and stored in the ROM 5*b*. Since the elapsed time t1 and the ink viscosity have a relationship in which, if one is determined, the other is uniquely determined, the time that elapsed before the ink viscosity reaches a predetermined threshold value (an ink viscosity at which the inner spaces K1 and K2 of the suction cap 71 cannot be decreased in pressure even by an ink sucking operation, and at which the ink is hardened) can be obtained. This elapsed time is the hardening time T5. The hardening time T5 thus derived is stored in the RAM 5*c*. Thereafter, the control unit 5 derives the second predetermined time T2 and the third predetermined time T3 that satisfy conditions similar to those in the above embodiment on the basis of the derived hardening time T5 and causes the RAM 5*c* to store them.

Next, the control unit 5 executes the process from SA5 to SA9 similar to the process from S4 to S8 described above. Thus, the ink discharging processes at SA6 and SA8 are completed. Also in this modification, as in the above embodiment, whether a sucking process is executed in accordance with an instruction from the operator is always monitored, so if the sucking process is executed, the processing in FIG. 17 returns to the start, and the process of SA1 is executed.

Figure 18:
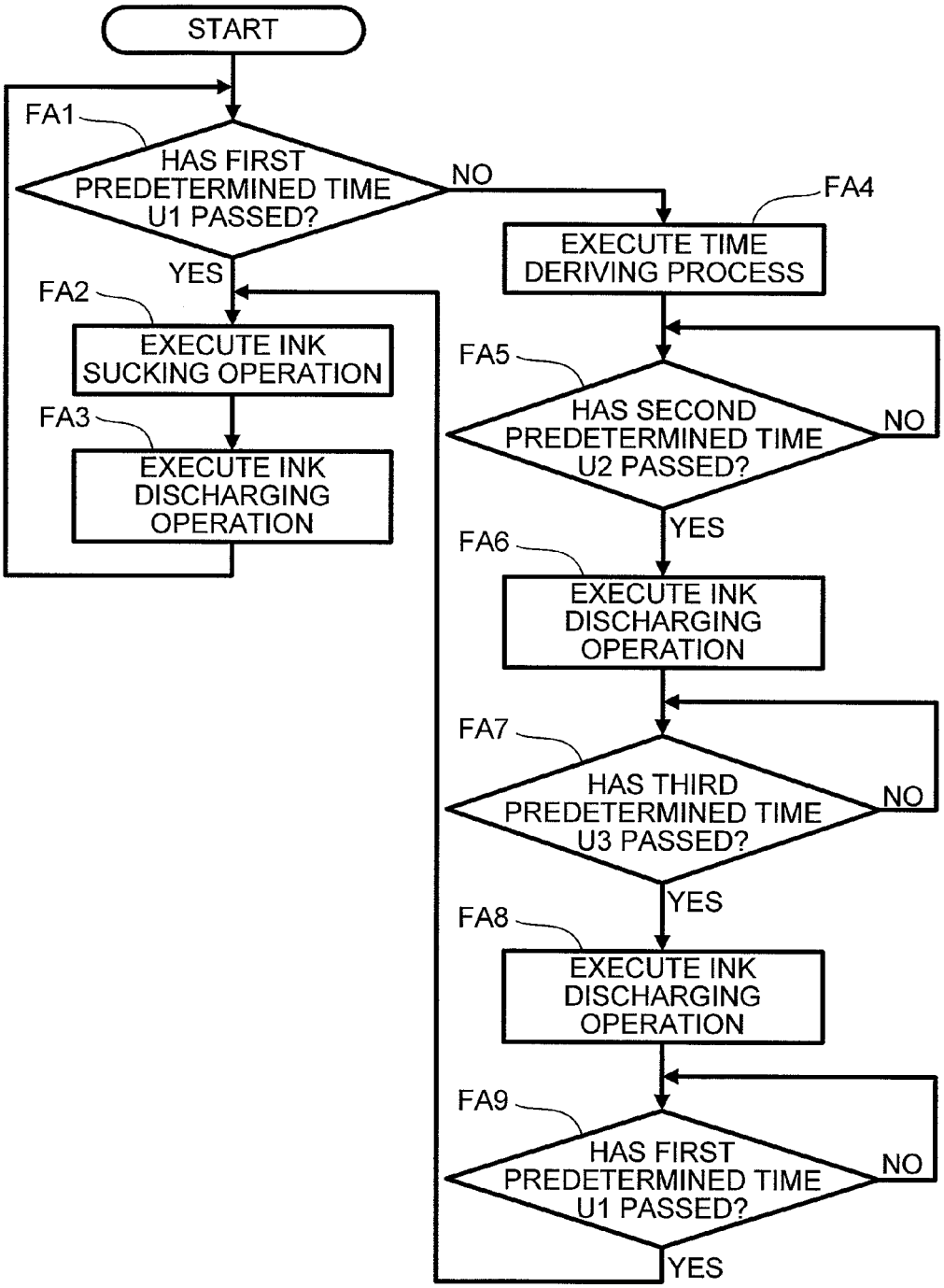
FIG. 18 is a flowchart illustrating the procedure of a periodic exhaust maintenance operation according to a modification of an embodiment of the present invention.

Also in a periodic exhaust maintenance operation, processes from FA1 to FA3 similar to the processes from F1 to F3 in the above embodiment are executed, as shown in FIG. 18. If at FA1 the first predetermined time U1 has not passed (FA1: NO), the control unit 5 executes a time deriving process (FA4).

At FA4, the control unit 5 derives the hardening time U5 of ink that partly remains in the connecting channel 69 after completion of the preceding exhaust process, as in the above. Thereafter, the control unit 5 derives the second predetermined time U2 and the third predetermined time U3 that satisfy the same conditions as those in the above embodiment on the basis of the derived hardening time U5 and causes the RAM 5*c* to store them.

Next, the control unit 5 executes the processes from FA5 to FA9 similar to those from F4 to F8 described above. Thus, the ink discharging process at FA6 and FA8 are completed. Also in this modification, as in the above embodiment, whether an exhausts process is executed in accordance with an instruction from the operator is always monitored, so if the exhaust process is executed, the processing in FIG. 18 returns to the start, and the process of FA1 is executed.

In this modification, the hardening times T5 and U5 are derived in the time deriving processes (SA4 and FA4) and the second predetermined times T2 and U2 and the third predetermined times T3 and U3 are derived after completion of the preceding sucking process and the preceding exhaust process. This allows hardening times T5 and U5 according to the operator's use environment to be derived, allowing the second predetermined times T2 and U2 and the third predetermined times T3 and U3 to be set according to the use environment. This can further prevent the connecting channel 69 from being clogged. The same configuration as that of the above embodiment offers the same advantageous effects.

While preferred embodiments of the present invention have been described, such description is for illustrative only, and it is to be understood that various modifications may be made within the scope of the claims. For example, in the above embodiment and modification, the hardening times T5 and U5 are employed as unflowable time. It may be the time until the viscosity of ink in the connecting channel 69 increases so that the ink cannot flow therein even if the suction pump 66 is driven for an ink sucking operation. That is, the unflowable time may be a time that is shorter than the hardening times T5 and U5 and that is taken for the ink to have a higher viscosity than usual to the extent that the ink is not hardened.

In the above embodiment, two ink discharge operations are executed in the ink discharging process. Alternatively, one or three or more ink discharge operations may be performed. The first ink discharge operation in the ink discharging process may be performed before the arrival time T6 or U6 passes. The last ink discharge operation in the ink discharging process may be executed within the fourth predetermined time T4 or U4.

In the case where a plurality of ink discharge operations are executed in the ink discharging process, the interval between adjacent ink discharge operations may be either the same or shorter in a later operation. An ink discharge operation in the sucking process may be performed after the third predetermined time T3 or U3 has passed from completion of an ink sucking operation.

The rotational speed of the suction pump 66 in executing the ink discharge operations in the ink discharging process may be equal to or higher than that for the ink discharge operations in the sucking process or the exhaust process. The operation times of the suction pump 66 when a plurality of ink discharge operations are executed in the ink discharging process may either be the same or be longer in a later operation.

In the above embodiment and modification, the selecting mechanism switches between a communicating state and a discommunicating state by opening or closing the open/close valve 180, with the suction cap 71 and the exhaust cap 72 moved to a contact position with the cap elevating mechanism 74. Alternatively, the cap elevating mechanism 74 and the switching mechanism 67 may constitute the selecting mechanism. In this case, the switching mechanism 67 further includes in the case 67*b* three ports respectively connected to the tubes 71*a*7, 71*b*7, and 72*g* and an atmosphere communication port. The switching member 67*a* is provided with a plurality of channel grooves connecting to the central groove 67*d*. The plurality of channel grooves can be switched, at a rotational position other than those in the first to third states, among a state in which the tube 71*a*1 communicates with the atmosphere while the suction pump 66 and the cap 71*a* communicate together, a state in which the tube 71*b*1 communicates with the atmosphere while the suction pump 66 and the cap 71*b* communicate together, and a state in which the tube 72*g* communicates with the atmosphere while the suction pump 66 and the exhaust cap 72 communicate together. This allows also the switching mechanism 67 to perform a liquid discharge operation in a state in which the suction cap 71 and the exhaust cap 72 are at the contact position in a communicating state. Disposing the switching member 67*a* in a state in which the channel grooves do not communicate with any ports, with the suction cap 71 and the exhaust cap 72 disposed at a contact position using the cap elevating mechanism 74 produces a discommunicating state. Alternatively, the recording head 41 may be moved to a contact position or a release position in the vertical direction A1 and the suction cap 71 may be fixed in the casing 11. In this case, the selecting mechanism switches between a communicating state and a discommunicating state by moving the recording head.

The communication holes 71*a*6, 71*b*6, and 72*f* may be each equipped with the open/close valve 180 directly mounted thereto. In this case, the three open/close valves 180 and the cap elevating mechanism 74 constitute the selecting mechanism according to an embodiment of the present invention.

Although the above describes an example in which the present invention is applied to a printer unit that performs recording by ejecting ink through nozzles, this is given for mere illustration and is not intended to limit the invention. The present invention may be applied to a liquid ejection apparatus, other than the printer unit, which ejects liquid other than ink through ejection ports. The present invention may be applied to both a line liquid ejection apparatus and a serial liquid ejection apparatus.

What is claimed is:

1. A liquid ejection apparatus configured to print on a medium by ejecting liquid, the liquid ejection apparatus comprising:

a liquid ejection head comprising an ejection port;

a cap member comprising a recess portion, the cap member configured to be in selective contact with the liquid ejection head to cover the ejection port, the recess portion forming an inner space of the cap member with the liquid ejection head when the cap member is in contact with the liquid ejection head;

a selector configured to select one of a first state in which the inner space formed by the recess portion and the liquid ejection head is not communicated with an outer space of the cap member when the cap member is in contact with the liquid ejection head and a second state in which the recess portion is communicated with the outer space of the cap member;

a waste liquid tank;

a pump;

a first connection channel fluidly connecting the recess portion of the cap member and the pump;

a second connection channel fluidly connecting the pump and the waste liquid tank;

a timer; and a controller configured to:

if a first time period measured by the timer has elapsed from completion of a previous regular maintenance, then control the selector and the pump to perform a first maintenance process that includes a purge operation in which liquid is discharged from the ejection port to the inner space of the cap member in the first state, and a first discharge operation in which liquid in the recess portion of the cap member is discharged to the waste liquid tank without discharging liquid from the ejection port in the second state after the purge operation; and if the first time period measured by the timer has not elapsed from completion of a previous regular maintenance, and if a second time period measured by the timer has elapsed from completion of the previous regular maintenance, the second time period being shorter than the first time period, then control the selector and the pump to perform a second maintenance process that includes a second liquid discharge operation in which liquid in the first connection channel is discharged to the waste liquid tank without discharging liquid from the ejection port in the second state without executing a purge operation after the second liquid discharge operation.

2. The liquid ejection apparatus of claim 1, wherein the controller configured to:

determine if the first time period measure by the timer as elapsed tight completion of previous regular maintenance; and if the controller determines that the first time period measured by the tinnier has not elapsed from completion of the previous regular maintenance, then determine if the second time period measured by the timer has elapsed from completion of the previous regular maintenance.

3. The liquid ejection apparatus of claim 1, wherein controller is configured to:

if the first time period measured by the timer has not elapsed from completion of a previous regular maintenance, and if the second time period measured by the timer has not elapsed from completion of the previous regular maintenance, then not execute the second liquid discharge operation.

4. The liquid ejection apparatus claim 1, wherein the controller is configured to:

if the first time period measured by the timer has not elapsed from completion of a previous regular maintenance, and if the second time period measured by the timer has elapsed from completion of the previous regular maintenance, then control the selector and the pump to perform the second liquid discharge operation, and not perform the first maintenance process.

5. The liquid ejection apparatus of claim 1, wherein the second time is equal to or longer than an arrival period from the completion of the previous maintenance process to a time when liquid remaining in the recess portion of the cap member arrives at the first connection channel.

6. The liquid ejection apparatus of claim 5, wherein the second time is shorter than a solidification period from the completion of the previous first maintenance process to a time when the liquid in the first connection channel solidifies.

7. The liquid ejection apparatus of claim 1, wherein the controller is configured to:

after controlling the selector and the pump to perform the first maintenance process, if the first time period measured by the timer has not elapsed from completion of the previous regular maintenance, and if the second time period measured by the timer has elapsed from completion of the previous regular maintenance, then control the selector and the pump to perform the second liquid discharge operation;

if a third time period measured by the timer has elapsed from completion of the second liquid discharge operation, then control the selector and the pump to perform a third liquid discharge operation in which liquid in the first connection channel is discharged to the waste liquid tank without discharging liquid from the ejection port in the second state, wherein the third time period is longer than the second time period; and if the first time period measured by the timer has elapsed after controlling the selector and the pump to perform the first maintenance process, then repeating the regular maintenance process.

8. The liquid ejection apparatus of claim 1, wherein the controller is configured to:

if a third time period measured by the tinier has elapsed from completion of the second liquid discharge operation, then control the selector and the pump to perform a third liquid discharge operation in which liquid in the first connection channel is discharged to the waste liquid tank without discharging liquid from the ejection port in the second state, and not execute the purge operation, just after the third liquid discharge operation, wherein the third time period is longer than the second time period, and wherein the third time period is shorter than the first time period.

9. The liquid ejection apparatus of claim 1, wherein the controller configured to:

control the selector and the pump to perform the first liquid discharge operation when the time elapsed from the completion of the purge operation reaches a sixth time period, wherein the sixth time period is shorter than both the second time and the third time period.

10. The liquid ejection apparatus of claim 1, wherein the controller is configured to:

control the pump to rotate at a first rotation speed during the first liquid discharge operation; and control the pump to rotate at a second rotation speed during the second liquid discharge operation, and wherein the second rotation speed is slower than the first rotation speed.

11. The liquid ejection apparatus of claim 1, wherein the controller is configured to:

if a third time period measured by the timer has elapsed from completion of the second liquid discharge operation, then control the selector and the pump to perform a third liquid discharge operation in which liquid in the first connection channel is discharged to the waste liquid tank without discharging liquid from the ejection port in the second state, control the pump to rotate at a third rotation speed during a first driving period in the second liquid discharge operation; and control the pump to rotate at a fourth rotation speed during a second driving period in the third liquid discharge operation, and wherein the fourth rotation speed is equal to the third rotation speed, and the second driving period is shorter than the first driving period.

12. The liquid ejection apparatus of claim 1, wherein the selector comprises a cap member movement mechanism configured to move the cap member between a capping position which the cap member is in contact with the liquid ejection head and a release position which the cap member separates from the liquid ejection head, and wherein the first state includes a state that the cap member is positioned at the capping position, and the second state includes a state that the cap member is positioned at the release position.

13. The liquid ejection apparatus of claim 1, wherein the selector includes a movement mechanism configured to move at least one of the cap member and the liquid ejection head relative to each other; and wherein the first state is selected when the cap member is in contacted with the liquid ejection head by the movement mechanism and the second state is selected when the cap is separated from the liquid ejection head by the movement mechanism.

14. The liquid ejection apparatus of claim 1, further comprising:

a temperature sensor configured to sense a temperature value of an ambient air; and a memory which stores information related to the first time period, the first time period calculated based on a water-vapor transmission coefficient of the first connection channel, a thickness of the first connection channel, data related to a relationship between an evaporation rate of the liquid and a viscosity of the liquid, and a threshold value of the viscosity of the liquid, wherein the controller is configured to control the selector and the pump to perform the second liquid discharge operation based on the temperature value sensed by the temperature sensor and the information stored in the memory.

15. The liquid ejection apparatus of claim 1, wherein the selector includes a valve connected to the cap member by a connection member, the cap member being in contact with the liquid ejection head; and wherein the first state is selected when the valve is in a closed state and the second state is selected when the valve is in an open state.

16. The liquid ejection apparatus of claim 1, wherein the controller is configured to:

if a third time period measured by the timer has elapsed from completion of the second liquid discharge operation, then control the selector and the pump to perform a third liquid discharge operation in which liquid in the first connection channel is discharged to the waste liquid tank without discharging liquid from the ejection port in the second state, and not execute the purge operation just after the third liquid discharge operation, and after completion of the third discharge operation, and if the first time period measured by the timer has elapsed from the completion of the previous regular maintenance, then control the selector and the pump to perform the first maintenance process regardless of elapsed time elapsed from completion of the third discharge operation, wherein the third time period is longer than the second time period, and wherein the third time period is shorter than the first time period.

17. A liquid ejection apparatus configured to print on a medium by ejecting liquid, the liquid ejection apparatus comprising:

a liquid ejection head comprising an ejection port;

a cap member comprising a recess portion, the cap member configured to be in selective contact with the liquid ejection head, to cover the ejection port, the recess portion forming an inner space of the cap member with the liquid ejection head when the cap member is in contact with the liquid ejection head;

a selector configured to select one of a first state which the inner space formed by the recess portion and the liquid ejection head is not communicated with an outer space of the cap member when the cap member is in contact with the liquid ejection head and a second state which the recess portion is communicated with the outer space of the cap member;

a waste liquid tank;

a pump;

a first connection channel fluidly connecting the recess portion of the cap member and the pump;

a second connection channel fluidly connecting the pump and the waste liquid tank;

a timer; and a controller configured to:

continuously monitor the timer, if a predetermined time period measured by the timer has elapsed from completion of a previous regular maintenance, then control the selector and the pump to perform a maintenance process that includes a liquid discharge operation in which liquid in the first connection channel is discharged to the waste liquid tank without discharging liquid from the ejection port in the second state without executing a purge operation in which liquid is discharged from the ejection port to the inner space of the cap member in the first state after the liquid discharge operation, wherein the predetermined time period is:

shorter than a predetermined maintenance time elapsed from completion of a previous regular maintenance, equal to or longer than an arrival period when liquid remaining in the recess portion of the cap member arrives at the first connection channel, and shorter than a solidification time when the liquid in the first connection channel solidifies, wherein the solidification time is shorter than the predetermined maintenance time.

18. The liquid ejection apparatus of claim 17, further comprising:

a temperature sensor configured to sense a temperature value of an ambient air; and a memory which stores information related to the predetermined maintenance time, the predetermined maintenance time calculated based on a water-vapor transmission coefficient of the first connection channel, a thickness of the first connection channel, data related to a relationship between an evaporation rate of the liquid and a viscosity of the liquid, and a threshold value of the viscosity of the liquid, wherein the controller is configured to control the selector and the pump to perform the liquid discharge operation based on the temperature value sensed by the temperature sensor and the information stored in the memory.

* * * * *